US012662635B2

(12) United States Patent
Radford et al.

(10) Patent No.: US 12,662,635 B2
(45) Date of Patent: Jun. 23, 2026

(54) PROCESSES AND SYSTEMS FOR CO-PROCESSING A HYDROCARBON FEED AND A HEAVY FEED CONTAINING A PLASTIC MATERIAL

(71) Applicant: ExxonMobil Technology and Engineering Company, Baytown, TX (US)

(72) Inventors: Kara R. Radford, Houston, TX (US); David Spicer, Houston, TX (US); Saurabh S. Maduskar, Houston, TX (US); Theodore W. Walker, Chittenango, NY (US); Alison M. Miller, Houston, TX (US); Steven M. Slack, Humble, TX (US)

(73) Assignee: ExxonMobile Technology and Engineering Company, Baytown, TX (US)

( * ) Notice: Subject to any disclaimer, the term of this patent is extended or adjusted under 35 U.S.C. 154(b) by 218 days.

(21) Appl. No.: 18/405,088

(22) Filed: Jan. 5, 2024

(65) Prior Publication Data

US 2024/0247193 A1 Jul. 25, 2024

Related U.S. Application Data

(60) Provisional application No. 63/480,608, filed on Jan. 19, 2023.

(51) Int. Cl.
*C10G 1/10* (2006.01)
*C10G 1/00* (2006.01)
(Continued)

(52) U.S. Cl.
CPC ..... *C10G 1/10* (2013.01); *C10G 1/002* (2013.01); *C10G 9/20* (2013.01); *C10G 9/36* (2013.01);
(Continued)

(58) Field of Classification Search
CPC ..... C10G 1/002; C10G 109/20; C10G 9/20; C10G 9/36; C10G 2300/1003;
(Continued)

(56) References Cited

U.S. PATENT DOCUMENTS 5,731,483 A 3/1998 Stabel et al.
6,681,568 B2 * 1/2004 Smith ..... F15B 11/162 60/456
(Continued)

FOREIGN PATENT DOCUMENTS

WO WO 2021/216281 10/2021
WO WO 2021/216285 10/2021
(Continued)

OTHER PUBLICATIONS

Kusenberg Marvin et al: "Towards high-quality petrochemical feedstocks from mixed plastic packaging waste via advanced recycling: The past, present and future", Fuel Processing Technology, Elsevier BV, NL, vol. 238, Sep. 6, 2022 (Sep. 6, 2022), XP087221376, ISSN: 0378-3820, DOI: 10.1016/J.FUPROC.2022.107474 [retrieved on Sep. 6, 2022] figures 6,12 4.1. Fractionation via distillation 5.4. Plastic waste pyrolysis oils as drop-in feedstocks for industrial crackers abstract.
(Continued)

*Primary Examiner* — James C Goloboy
(74) *Attorney, Agent, or Firm* — WOMBLE BOND DICKINSON (US) LLP; Kevin Davis

(57) ABSTRACT

Processes and systems for hydrocarbon pyrolysis. In some embodiments, a hydrocarbon can be heated within a convection section of a steam cracking furnace and combined with an aqueous fluid to produce a heated mixture. A heavy feed that includes a plastic material can be introduced into a vessel and a portion of the plastic material can be cracked therein. Liquid and vapor effluents exiting the vessel can be
(Continued)

obtained. At least a portion of the liquid effluent can be heated to produce a heated fluid stream that can be recycled to the vessel. The vapor effluent can be combined with the heated mixture to produce a combined mixture that can be heated within the convection section to produce a heated combined mixture. At least a portion of the heated combined mixture can be cracked within a radiant section of the steam cracking furnace to produce a steam cracker effluent.

16 Claims, 5 Drawing Sheets

(51) Int. Cl.
*C10G 9/20* (2006.01)
*C10G 9/36* (2006.01)
*C10G 70/04* (2006.01)

(52) U.S. Cl.
CPC ... *C10G 70/046* (2013.01); *C10G 2300/1003* (2013.01); *C10G 2300/1033* (2013.01); *C10G 2300/1037* (2013.01); *C10G 2300/202* (2013.01); *C10G 2300/4006* (2013.01); *C10G 2300/4037* (2013.01); *C10G 2300/4081* (2013.01); *C10G 2300/802* (2013.01); *C10G 2300/807* (2013.01); *C10G 2400/20* (2013.01)

(58) Field of Classification Search
CPC .... C10G 2300/1033; C10G 2300/1037; C10G 2300/202; C10G 2300/4006; C10G 2300/4037; C10G 2300/4081; C10G 2300/802; C10G 2300/807; C10G 2400/20
See application file for complete search history.

(56) References Cited

U.S. PATENT DOCUMENTS

| | | | | |
|---|---|---|---|---|
| 7,578,929 | B2 | 8/2009 | Stell et al. | |
| 7,820,035 | B2 | 10/2010 | McCoy et al. | |
| 12,065,616 | B2 | 8/2024 | Uppili et al. | |
| 2009/0050530 | A1 | 2/2009 | Spicer et al. | |
| 2020/0080009 | A1 | 3/2020 | Derks | |
| 2022/0177788 | A1 | 6/2022 | Bitting et al. | |
| 2022/0195309 | A1 | 6/2022 | Uppili et al. | |
| 2022/0372375 | A1 | 11/2022 | Patel et al. | |
| 2022/0389327 | A1 | 12/2022 | Reimers | |
| 2023/0013408 | A1* | 1/2023 | Hirst | C10G 9/36 |
| 2023/0159834 | A1 | 5/2023 | Maduskar et al. | |
| 2024/0110109 | A1 | 4/2024 | Laurent et al. | |
| 2024/0191148 | A1 | 6/2024 | Patel et al. | |
| 2024/0247194 | A1 | 7/2024 | Radford et al. | |
| 2025/0230365 | A1* | 7/2025 | Kandel | B01D 53/02 |

FOREIGN PATENT DOCUMENTS

| | | |
|---|---|---|
| WO | WO 2022/020152 | 1/2022 |
| WO | WO 2024/155488 | 7/2024 |

OTHER PUBLICATIONS

Heinz Zimmermann et al: "Ethylene" In: "Ullmann's Encyclopedia of Industrial Chemistry", Apr. 15, 2009 (Apr. 15, 2009), Wiley-VCH Verlag, Weinheim, XP055007506, ISBN: 978-3-52-730673-2 DOI: 10.1002/14356007.a10_045.pub3, Decoking on pp. 29-30 figures 4,10.

* cited by examiner

PROCESSES AND SYSTEMS FOR CO-PROCESSING A HYDROCARBON FEED AND A HEAVY FEED CONTAINING A PLASTIC MATERIAL

CROSS-REFERENCE TO RELATED APPLICATIONS

This application claims priority to and the benefit of U.S. Provisional Application No. 63/480,608 having a filing date of Jan. 19, 2023, the disclosure of which is incorporated herein by reference in its entirety.

FIELD

This disclosure relates to processes and systems for co-processing a hydrocarbon feed and a heavy feed containing a plastic material. More particularly, this disclosure relates to processes and systems for co-processing a mixture that includes a hydrocarbon feed, steam, and a vapor phase effluent by steam cracking the mixture, where the vapor phase effluent is produced by cracking a plastic material under plastic pyrolysis conditions.

BACKGROUND

Plastic materials provide environmental benefits, such as reducing the weight of passenger vehicles, e.g., cars and airplanes, to improve fuel economy. Plastic materials have become invaluable in all aspects of life, from healthcare to food production, packaging, and medical equipment. Post-use management of plastic materials is exercised to widely varying degrees throughout the world. One preferred management approach is to collect and recycle post-use plastic material to reduce the potential of such material to overburden landfills and/or to enter the environment, e.g., river and/or ocean systems.

Various techniques have been employed to recycle plastic materials, such as mechanical recycling and advanced recycling. In advanced recycling, the plastics are broken down to smaller hydrocarbon chains and monomers that can be processed to produce various chemicals such as one or more light olefin monomers. The current advanced recycling processes used to recycle plastic materials, however, typically require high energy usage, high capital, and produce relatively low yields of useful chemicals, e.g., light olefin monomers, which can be used to make new end products.

There is a need, therefore, for improved processes and systems for recycling plastic materials. This disclosure satisfies this and other needs.

SUMMARY

Processes and systems for converting hydrocarbons by pyrolysis are provided. In some embodiments, the process can include heating a hydrocarbon feed within a convection section of a steam cracking furnace and combining the hydrocarbon feed with an aqueous fluid to produce a heated mixture comprising hydrocarbons and steam. The heating can be carried out before, during, and/or after the hydrocarbon feed is combined with the aqueous fluid. A heavy feed that can include a plastic material can be introduced into a vessel. A portion of the plastic material can be cracked in the vessel under plastic pyrolysis conditions. A liquid phase effluent and a vapor phase effluent exiting the vessel can be obtained. At least a portion of the liquid phase effluent can be heated to produce a heated fluid stream. The heated fluid stream can be recycled to the vessel. The vapor phase effluent can be combined with the heated mixture to produce a combined mixture. The combined mixture can be heated within the convection section of the steam cracking furnace to produce a heated combined mixture. The heated combined mixture can be steam cracked within a radiant section of the steam cracking furnace to produce a steam cracker effluent that can include olefins.

In other embodiments, the process for converting hydrocarbons by pyrolysis, can include heating a hydrocarbon feed within a convection section of a steam cracking furnace and combining the hydrocarbon feed with an aqueous fluid to produce a heated mixture comprising hydrocarbons and steam. The heating can be carried out before, during, and/or after the hydrocarbon feed is combined with the aqueous fluid. The heated mixture can be a two-phase gas/liquid mixture. The heated mixture and a heavy feed that can include a plastic material can be introduced into a vessel. A portion of the plastic material can be cracked within the vessel under plastic pyrolysis conditions. A liquid phase effluent and a vapor phase effluent exiting the vessel can be obtained. At least a portion of the liquid phase effluent can be heated to produce a heated fluid stream. The heated fluid stream can be recycled to the vessel. The vapor phase effluent can be heated within the convection section of the steam cracking furnace to produce a heated vapor phase effluent. The heated vapor phase effluent can be steam cracked within a radiant section of the steam cracking furnace to produce a steam cracker effluent that can include olefins.

In other embodiments, the process for converting hydrocarbons by pyrolysis can include heating a hydrocarbon feed within a convection section of a steam cracking furnace and combining the hydrocarbon feed with an aqueous fluid to produce a heated mixture that can include hydrocarbons and steam. The heating can be carried out before, during, and/or after the hydrocarbon feed is combined with the aqueous fluid. The heated mixture can be a two-phase gas/liquid mixture. The heated mixture and a heavy feed that can include a plastic material can be introduced into a vessel. A portion of the plastic material can be cracked within the vessel under plastic pyrolysis conditions. A first liquid phase effluent, a second liquid phase effluent, and a vapor phase effluent exiting the vessel can be obtained. At least a portion of the first liquid phase effluent can be heated to produce a heated first fluid stream. The heated first fluid stream can be recycled to the vessel. The second liquid phase effluent can be heated within the convection section of the steam cracking furnace to produce a heated second fluid stream. The heated second fluid stream can be introduced into a separation drum. A vapor phase overhead and a liquid phase bottoms can be obtained from the separation drum. The vapor phase overhead can be steam cracked within a radiant section of the steam cracking furnace to produce a steam cracker effluent that can include olefins.

BRIEF DESCRIPTION OF THE DRAWINGS

The subject disclosure is further described in the detailed description that follows in reference to the drawings by way of non-limiting embodiments, in which like reference numerals represent similar parts throughout the several embodiments shown in the drawings.

DETAILED DESCRIPTION

Figure 1:
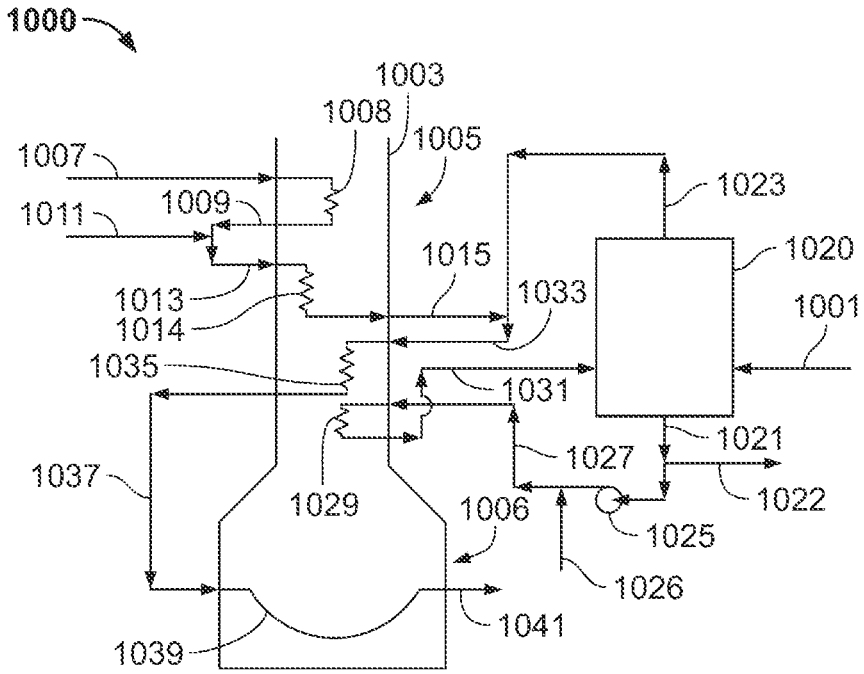
FIG. 1 depicts an illustrative process/system for steam cracking a mixture that includes a hydrocarbon feed/steam mixture and a vapor phase effluent derived from a heavy feed that can include a plastic material, which utilizes heat from a convection section of a steam cracking furnace to produce the vapor phase effluent, according to one or more embodiments described.

Various specific embodiments, versions and examples of the invention will now be described, including preferred embodiments and definitions that are adopted herein for purposes of understanding the claimed invention. While the following detailed description gives specific preferred embodiments, those skilled in the art will appreciate that these embodiments are exemplary only, and that the invention may be practiced in other ways. For purposes of determining infringement, the scope of the invention will refer to any one or more of the appended claims, including their equivalents, and elements or limitations that are equivalent to those that are recited. Any reference to the "invention" may refer to one or more, but not necessarily all, of the inventions defined by the claims.

In this disclosure, a process is described as including at least one "step." It should be understood that each step is an action or operation that may be carried out once or multiple times in the process, in a continuous or discontinuous fashion. Unless specified to the contrary or the context clearly indicates otherwise, multiple steps in a process may be conducted sequentially in the order as they are listed, with or without overlapping with one or more other steps, or in any other order, as the case may be. In addition, one or more or even all steps may be conducted simultaneously with regard to the same or different batch of material. For example, in a continuous process, while a first step in a process is being conducted with respect to a raw material just fed into the beginning of the process, a second step may be carried out simultaneously with respect to an intermediate material resulting from treating the raw materials fed into the process at an earlier time in the first step. Preferably, the steps are conducted in the order described.

Unless otherwise indicated, all numbers indicating quantities in this disclosure are to be understood as being modified by the term "about" in all instances. It should also be understood that the precise numerical values used in the specification and claims constitute specific embodiments. Efforts have been made to ensure the accuracy of the data in the examples. However, it should be understood that any measured data inherently contains a certain level of error due to the limitation of the technique and/or equipment used for making the measurement.

Certain embodiments and features are described herein using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated.

As used herein, the indefinite article "a" or "an" shall mean "at least one" unless specified to the contrary or the context clearly indicates otherwise. Thus, embodiments using "a steam cracking furnace" include embodiments where one, two, or more steam cracking furnaces are used, unless specified to the contrary or the context clearly indicates that only one steam cracking furnace is used.

The term "hydrocarbon" as used herein means (i) any compound consisting of hydrogen and carbon atoms or (ii) any mixture of two or more such compounds in (i). The term "Cn hydrocarbon," where n is a positive integer, means (i) any hydrocarbon compound comprising carbon atom(s) in its molecule at the total number of n, or (ii) any mixture of two or more such hydrocarbon compounds in (i). Thus, a C2 hydrocarbon can be ethane, ethylene, acetylene, or mixtures of at least two of these compounds at any proportion. A "Cm to Cn hydrocarbon" or "Cm-Cn hydrocarbon," where m and n are positive integers and $m<n$, means any of Cm, Cm+1, Cm+2, . . . , Cn−1, Cn hydrocarbons, or any mixtures of two or more thereof. Thus, a "C2 to C3 hydrocarbon" or "C2-C3 hydrocarbon" can be any of ethane, ethylene, acetylene, propane, propene, propyne, propadiene, cyclopropane, and any mixtures of two or more thereof at any proportion between and among the components. A "saturated C2-C3 hydrocarbon" can be ethane, propane, cyclopropane, or any mixture thereof of two or more thereof at any proportion. A "Cn+ hydrocarbon" means (i) any hydrocarbon compound comprising carbon atom(s) in its molecule at the total number of at least n, or (ii) any mixture of two or more such hydrocarbon compounds in (i). A "Cn− hydrocarbon" means (i) any hydrocarbon compound comprising carbon atoms in its molecule at the total number of at most n, or (ii) any mixture of two or more such hydrocarbon compounds in (i). A "Cm hydrocarbon stream" means a hydrocarbon stream consisting essentially of Cm hydrocarbon(s). A "Cm-Cn hydrocarbon stream" means a hydrocarbon stream consisting essentially of Cm-Cn hydrocarbon(s).

The term "crude" means whole crude oil as it flows from a wellhead, a production field facility, a transportation facility, or other initial field processing facility, optionally including crude that has been processed by a step of desalting, treating, and/or other steps as may be necessary to render it acceptable for conventional distillation in a refinery. Crude is presumed to contain resid. The term "crude fraction" means a hydrocarbon fraction obtained via the fractionation of crude. Non-limiting examples of crudes can be or can include, but are not limited to, Tapis, Murban, Arab Light, Arab Medium, and/or Arab Heavy.

The term "resid" refers to a bottoms cut of a crude distillation process that contains non-volatile components. Resids are complex mixtures of heavy petroleum compounds otherwise known in the art as residuum or residual or pitch. Atmospheric resid is the bottoms product produced from atmospheric distillation of crude where a typical endpoint of the heaviest distilled product is nominally 343° C., and is referred to as 343° C. resid. The term "nominally", as used herein, means that reasonable experts may disagree on the exact cut point for these terms, but by no more than +/−55.6° C. preferably no more than +/−27.8° C. Vacuum resid is the bottoms product from a distillation column operated under vacuum where the heaviest distilled product can be nominally 566° C., and is referred to as 566° C. resid.

The term "hydrocarbon feed" refers to a composition that includes one or more hydrocarbons. Illustrative hydrocarbon feeds can be or can include, but are not limited to, crude, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids and/or gases, natural gasoline, distillate, virgin naphtha, atmospheric pipestill bottoms, vacuum pipestill streams such as vacuum pipestill bottoms and wide boiling range vacuum pipestill naphtha to gas oil condensates, non-virgin hydrocarbons from refineries, vacuum gas oils, heavy gas oil, naphtha contaminated with crude, atmospheric residue, heavy residue, a $C_4$/residue admixture, naphtha/residue admixture, hydrocarbon gases/residue admixture, hydrogen/residue admixtures, waxy residues, gas oil/residue admixture, relatively light alkanes, e.g., ethane, propane, butane, and/or pentane, recycle streams that can include ethane, propane, ethylene, propylene, butadiene, or a mixture thereof, one or more condensates, fractions thereof, or any mixture thereof.

The term "non-volatile components" as used herein refers to the fraction of a hydrocarbon-containing feed, e.g., a petroleum feed, having a nominal boiling point of at least 590° C., as measured by ASTM D6352-15 or D-2887-18. Non-volatile components include coke precursors, which are large, condensable molecules that condense in the vapor and then form coke during steam cracking of the hydrocarbon feed.

The term "coke" refers to the solid or semi-solid product that can be produced during the steam cracking of hydrocarbons that includes carbon and high carbon-content organic molecules, whether produced within the convection section, radiant section, transfer lines therebetween, or within transfer lines and other equipment, e.g., a transfer line heat exchanger, downstream of the radiant section.

The term "asphaltene" refers to a material obtainable from crude oil or other sources and having an initial boiling point above 650° C. and which is insoluble in a paraffinic solvent.

A "polymer" has two or more of the same or different repeating units/mer units or simply units. A "homopolymer" is a polymer having repeating units that are the same. A "copolymer" is a polymer having two or more repeating units that are different from each other. As such, the term "copolymer" includes terpolymers (a polymer having three units that are different from each other), tetrapolymers (a polymer having four units that are different from each other), and so on. The term "different" as used to refer to units indicates that the units differ from each other by at least one atom and/or are different isomerically.

In some embodiments, the polymer can be or can include, but is not limited to, a nitrogen-containing polymer, a chlorine-containing polymer, a bromine-containing polymer, a fluorine-containing polymer, an oxygen-containing polymer, a polyethylene polymer, a polypropylene polymer, a polystyrene polymer, a butadiene polymer, an isoprene polymer, an isobutylene polymer, or any mixture thereof. In some embodiments, the oxygen-containing polymer can be or can include a polyterephthalate polymer, an ethylene vinyl acetate polymer, a polycarbonate polymer, a polylactic acid polymer, an acrylate polymer, a polyoxymethylene polymer, a polyester polymer, a polyoxybenzylmethylenglycolanhydride polymer, a polyepoxide polymer, or any mixture thereof. In some embodiments, the nitrogen-containing polymer can be or can include one or more polyamide polymers, e.g., nylon; one or more polynitrile polymers, e.g., poly(acrylonitrile) and/or poly(methacrylonitrile); one or more aramids, one or more polyurethane polymers, or any mixture thereof. It is noted that polyamides, among other nitrogen-containing polymers, also contain oxygen as part of the polymer structure. In this disclosure, a polymer that includes both oxygen and nitrogen as part of the repeat unit for forming the polymer is defined as a nitrogen-containing polymer for purposes of characterizing the plastic feedstock. In some embodiments, the chlorine-containing polymers can be or can include, but are not limited to, polyvinyl chloride (PVC) and/or polyvinylidene chloride (PVDC). A polymer can be naturally occurring, modified naturally occurring, and/or synthetic.

The term "plastic material" refers to a composition that includes one or more polymers. Preferably, the plastic material comprises, consists essentially of, or consists of a synthetic polymer. Preferably, the plastic material comprises, consists essentially of, or consists of a used polymer. Preferably, the plastic material comprises, consists essentially of, or consists of one or more polymers derived from one or more olefin monomers (e.g., polyethylene, polypropylene, polyethylenepropylene, polystyrene, and the like).

It is noted that some types of plastic material can also include bio-derived components. For example, some types of plastic labels can include biogenic waste in the form of paper compounds. In some embodiments, 1 wt % to 25 wt % of the plastic material can correspond to bio-derived material. Such bio-derived material can also potentially contribute to the nitrogen content of a plastic material. The plastic material, in addition to the one or more polymers, can also include any additives, modifiers, packaging dyes, and/or other components typically added to a polymer during and/or after formulation. The plastic material can also further include any components typically found in polymer waste.

The plastic material alone or the plastic material mixed, blended, or otherwise combined with an optional carrier liquid is also referred to as a "heavy feed." Although the heavy feed may have a similar or identical composition as the hydrocarbon feed, preferably the heavy feed differs from the hydrocarbon feed. Although the hydrocarbon feed may contain a plastic material, e.g., the same or different plastic material contained in the heavy feed, preferably the hydrocarbon feed is substantially free, or completely free of a plastic material. Preferably, the hydrocarbon feed is derived from a petroleum source substantially free or completely free of a plastic material.

The optional "carrier liquid" disclosed herein that can be contacted with the plastic material and/or a liquid phase effluent at least partially derived from the plastic material can be or can include, but is not limited to, a wide range of petroleum or petrochemical products or streams (e.g., hydrocarbon products and/or intermediate streams produced from petroleum processing such as distillation, steam cracking, catalytic cracking, refining, and the like). For example, some suitable carrier liquids can correspond to, include, comprise, consist essentially of, or consist of:

(i) naphtha, kerosene, diesel, light or heavy cycle oils, catalytic slurry oil, gas-oils, white oils, derived from sources including but not limited to petroleum sources, e.g., from a refinery, a steam cracker, and/or a coker;
(ii) isoparaffins;
(iii) metallocene-derived hydrocarbons;
(iv) hydrocarbons produced from biologically derived raw materials;
(v) hydrocarbons derived from coal processing;
(vi) biologically derived raw materials for producing hydrocarbons;
(vii) ethylene-propylene copolymers; polybutenes;
(viii) polyalphaolefins ("PAOs"), including but not limited those described in or obtainable by using the processes described in U.S. Pat. Nos. 9,365,788, 9,409,834, 4,827,064, and 5,264,642;
(ix) alkylated benzenes;
(x) alkylated naphthalenes ("ANs");
(xi) esters such as adipate esters, phthalate esters, trimellitate esters, polyol esters (e.g., trimethylolpropane ("TMP") esters, pentaerythritol ("PE") esters, and blends thereof; and esters suitable for jet oils);
(xii) polyethers/polyalkylene glycols;
(xiii) thermally stable liquids, e.g., DOWTHERM® A available from Dow Chemical Company;
(xiv) naphthenic and/or aromatic solvents, such as toluene, benzene, methylnaphthalene, cyclohexane, methylcyclohexane, mineral oil, or any mixture thereof;
(xv) Group I, II, III, IV, or V lubricant basestocks, description of which can be found in EP2828367A1, which are incorporate herein by reference, including re-refined basestocks;
(xvi) lubricant formulations comprising any Group I, II, III, IV, or V lubricant basestock;
(xvii) crudes, condensates, or any mixture thereof;
(xviii) any formulation comprising one or more of the foregoing in one or more of groups (i) to (xvii); and
(xix) any mixture comprising two or more of the foregoing in one or more of groups (i) to (xvii), e.g., PAO/AN blends.

In some embodiments, the carrier liquid can be, can include, or can comprise a heat-soaked and/or hydrotreated hydrocarbon stream having an initial boiling point of at least 300° C. Boiling point distributions (the distribution at atmospheric pressure) can be determined, e.g., by conventional methods such as ASTM D7500-15(2019) or ASTM-D86-20b. A suitable heat-soaked hydrocarbon steam having an initial boiling point of at least 300° C. can be produced according to the processes disclosed in WO Publication No. WO2018/111577A1. A suitable hydrotreated hydrocarbon stream having an initial boiling point of at least 300° C. can be produced according to the processes disclosed in WO Publication No. WO2018/111577A1. A suitable heat-soaked and hydrotreated hydrocarbon stream having an initial boiling point of 300° C. can be produced according to the processes disclosed in WO Publication No. WO2018/111577A1. In some embodiments, when the heavy feed includes the plastic material combined with the carrier liquid, the heavy feed can be in the form of a solution, slurry, suspension, dispersion, or other fluid-type phase. As such, in some embodiments, the carrier liquid can act as a solvent.

The term "aqueous fluid" refers to a composition that includes water in the liquid phase, water in the vapor phase, or a mixture of water in the liquid phase and water in the vapor phase.

The terms "char" and "ash" interchangeably refer to the solid or solid/liquid mixture produced during the pyrolysis of an optionally contaminated plastic material and deposited on the inner surface of a conduit or vessel, which can include organic molecules having long carbon chains and/or high boiling points such as asphaltenes, coke, organometallic compounds, inorganic materials such as metals, metallic oxides, and salts, and mixtures thereof. Char and ash can be produced from the chemical reactions of the various components of a plastic material and/or introduced directly from the plastic feed material.

An "olefin" is a linear, branched, or cyclic compound of carbon and hydrogen having at least one double bond. The term "olefin product" as used herein means a product that includes an olefin, preferably a product consisting essentially of or consisting of an olefin. An olefin product in the meaning of this disclosure can be, e.g., an ethylene stream, a propylene stream, a butylene stream, an ethylene/propylene mixture stream, and the like.

The term "consisting essentially of" as used herein means the composition, feed, effluent, product, or other stream comprises a given component at a concentration of at least 60 wt %, preferably at least 70 wt %, more preferably at least 80 wt %, more preferably at least 90 wt %, still more preferably at least 95 wt %, based on the total weight of the composition, feed, effluent, product, or other stream in question.

The term "aromatic" as used herein is to be understood in accordance with its art-recognized scope which includes alkyl substituted and unsubstituted mono- and poly-nuclear compounds.

The term "rich" when used in phrases such as "X-rich" or "rich in X" means, with respect to an outgoing stream obtained from a device, that the stream comprises material X at a concentration higher than in the feed material fed to the same device from which the stream is derived.

The term "lean" when used in phrases such as "X-lean" or "lean in X" means, with respect to an outgoing stream obtained from a device, that the stream comprises material X at a concentration lower than in the feed material fed to the same device from which the stream is derived.

The terms "channel" and "line" are used interchangeably and mean any conduit configured or adapted for feeding, flowing, and/or discharging a vapor, a liquid, and/or a solid into the conduit, through the conduit, and/or out of the conduit, respectively. For example, a composition can be fed into the conduit, flow through the conduit, and can be discharged from the conduit to move the composition from a first location to a second location. Suitable conduits can be or can include, but are not limited to, pipes, hoses, ducts, tubes, and the like.

As used herein, "wt %" means percentage by weight, "vol %" means percentage by volume, "mol %" means percentage by mole, "ppm" means parts per million, and "ppm wt" and "wppm" are used interchangeably to mean parts per million on a weight basis. All concentrations herein are expressed on the basis of the total amount of the composition in question, unless specified otherwise. All ranges expressed herein should include both end points as two specific embodiments unless specified or indicated to the contrary.

Processes/Systems for Converting Hydrocarbons by Pyrolysis

A description of the processes/systems of this disclosure will now be made by referencing the non-limiting drawings showing various preferred embodiments.

FIG. 1 depicts an illustrative process/system 1000 for steam cracking a mixture in line 1037 that includes a hydrocarbon feed/steam mixture in line 1015 and a vapor phase effluent in line 1023 derived from a heavy feed in line 1001 that can include a plastic material, which utilizes heat from a convection section 1005 of a steam cracking furnace 1003 to produce the vapor phase effluent in line 1023, according to one or more embodiments. In some embodiments, the plastic material in the heavy feed in line 1001 can have been treated to remove at least a portion of any contaminants therefrom. In other embodiments, the plastic material in the heavy feed in line 1001 can be used as received. If the plastic material is treated to remove at least a portion of any contaminants therefrom, such treatment can include, but is not limited to, sortation, filtration, water washing, solvent extraction, contact with super-critical water, contact with supercritical carbon dioxide, or any combination thereof. In some embodiments, the plastic material in the heavy feed in line 1001 can have been subjected to one or more physical processes such as chopping, grinding, shredding, or other suitable process that can reduce the size of the plastic material. In some embodiments, the plastic material can have a median particle size of 10 cm or less, 3 cm or less, 2.5 cm or less, 2 cm or less, 1 cm or less, 0.1 cm or less, or 0.01 cm or less.

The heavy feed in line 1001, treated and/or subjected to one or more physical processes or as received, can be introduced into a vessel 1020. In some embodiments, the process/system 1000 can include two or more vessels 1020 with each vessel 1020 configured to receive a portion of the heavy feed in line 1001 and/or separate heavy feeds having the same or different compositions with respect to one another. In some embodiments, the heavy feed in line 1001 can be introduced into the vessel 1020 at ambient temperature. In other embodiments, the heavy feed in line 1001 can be pre-heated to a temperature in a range, e.g., from 50° C., 75° C., 100° C., or 150° C. to 200° C., 275° C., or 350° C. At least a portion of the plastic material in the heavy feed introduced via line 1001 into the vessel 1020 can be cracked in the vessel 1020 under plastic pyrolysis conditions to produce the vapor phase effluent and a liquid phase effluent that can be recovered or otherwise obtained via lines 1023 and 1021, respectively, from the vessel 1020.

In some embodiments, the plastic pyrolysis conditions in the vessel 1020 can include an average temperature in the vessel 1020 in a range, e.g., from 275° C., 300° C., 325° C., 350° C., or 375° C. to 400° C., 425° C., 450° C., 475° C., 500° C., 525° C., or 550° C. Under such temperature, the plastic material and some heavy hydrocarbons undergo thermal pyrolysis to produce smaller, lighter molecules, e.g., molecular hydrogen, $C_1$-$C_4$ hydrocarbons, and $C_{5+}$ hydrocarbons, in the vessel 1020. Thus, the vessel 1020 serves in part as a thermal pyrolysis reactor. The thermal pyrolysis reactions can be generally endothermic. In some embodiments, such desirable temperature in the vessel 1020 can be partly achieved and maintained by including an internal heater (e.g., a heat exchanger) in the vessel 1020, in addition to heating via exchanger 1029 of the recycle fluid stream 1027 and/or pre-heating of stream 1001. In a preferred embodiment, however, no internal heater is installed within vessel 1020 to reduce fouling and simplify necessary cleaning inside vessel 1020, and the temperature in vessel 1020 is achieved and/or maintained by the suitable temperature and flow rate of streams in lines 1001 and 1031 as described below. In preferred embodiments, the heavy feed stream in line 1001 has a temperature lower (e.g., 100° C., 120° C., 140° C., 150° C., 160° C., 180° C., 200° C., 220° C., 240° C., 250° C., 260° C., 280° C., 300° C. lower) than that of the fluid stream in line 1031. Inside vessel 1020, fluids from lines 1001 and 1031 can be mixed (e.g., by one or more agitating means such as a rotating mixer inside the vessel 1020, not shown) to achieve the desired average temperature inside the vessel. In some embodiments, the plastic pyrolysis conditions in the vessel 1020 can include a pressure in the vessel in a range, e.g., from 350 kPa-gauge, 500 kPa-gauge, 700 kPa-gauge, or 1,000 kPa-gauge to 1,250 kPa-gauge, 1,500 kPa-gauge, or 1,750 kPa-gauge. In some embodiments, the plastic pyrolysis conditions in the vessel 1020 can include a residence time in the vessel 1020 sufficient to crack at least a portion of the plastic material. Depending, at least in part, on the composition and amount of the plastic material in the heavy feed introduced via in line 1001 into the vessel 1020, the temperature within the vessel 1020 and/or the amount of time required to crack a desired amount of the plastic material can widely vary. Typically, increasing the temperature can reduce the amount of time required for a given quantity of a given plastic material to be cracked under the plastic pyrolysis conditions to produce the vapor phase effluent and the liquid phase effluent.

In some embodiments, at least a portion of the plastic material in the liquid phase effluent in line 1021 can be at least partially melted. In some embodiments, at least a portion of the plastic material in the liquid phase effluent in line 1021 can be at least partially cracked such that at least a portion of the plastic material has been converted to one or more smaller chain polymers as compared to the plastic material in the heavy feed in line 1001.

The vapor phase effluent in line 1023 can be in the gas phase or can primarily be in the gas phase with a minor amount in the liquid phase. When a minor amount of the vapor phase effluent in line 1023 is in the liquid phase, such minor amount can be up to about 5 wt %, 4 wt %, 3 wt %, 2 wt %, 1 wt %, 0.5 wt %, 0.1 wt %, or 0.01 wt %, based on the total weight of the vapor phase effluent. The vapor phase effluent in line 1023 can be or can include, but is not limited to, one or more hydrocarbons produced by pyrolyzing the plastic material within the vessel 1020. In some embodiments, the vapor phase effluent in line 1023 can also include one or more hydrocarbons produced by vaporizing and/or pyrolyzing a carrier liquid or other hydrocarbon-containing stream within the vessel 1020.

At least a portion of the liquid phase effluent in line 1021 can be pumped via one or more pumps 1025 into line 1027 that can be in fluid communication with an internal heat exchanger 1029 disposed within the convection section 1005 of the steam cracking furnace 1003. In some embodiments, a portion of the liquid phase effluent in line 1021 can be removed via line 1022 from the process/system 1000. In addition to the hydrocarbons present in the liquid phase, the liquid phase effluent in line 1021 can also include char. As such, removing a portion of the liquid phase effluent via line 1022 can also remove at least portion of the char from the process/system 1000. In some embodiments, the liquid phase effluent in line 1021 can be subjected to a separation process that can increase the amount of char and reduce the amount of non-char components in the liquid phase effluent being removed via line 1022 from the process/system 1000.

In some embodiments, a liquid medium in line 1026, e.g., the carrier liquid, can be mixed, blended, combined, or otherwise contacted with the liquid phase effluent in line 1027. In some embodiments, when the heavy feed in line 1001 includes a majority or only one or more plastic materials, contacting the liquid phase effluent in line 1027 with the liquid medium can help facilitate the flow of the liquid phase effluent within line 1027 by forming a mixture having a reduced viscosity or otherwise improving flow through dilution as compared to the liquid phase effluent before combining with the liquid medium. In other embodiments, at least a portion of the liquid medium in line 1026 can be combined with the liquid phase effluent in line 1021 upstream of the pump 1025, within the vessel 1020, and/or with a heated fluid stream in line 1031 (further described below). In some embodiments, the flow rate of the heavy feed in line 1001 and, when present, the flow rate of the liquid medium in line 1026 can be controlled through level control on the vessel 1020 and through the flow rate of the purge stream removed via line 1022 from the process/system 1000.

The liquid phase effluent in line 1027 can be heated within the heat exchanger 1029 disposed within the convection section 1005 of the steam cracking furnace 1003 to produce a heated fluid stream via line 1031 that can be recycled into the vessel 1020. The heat exchanger 1029 can include a single pass or multiple passes through the convection section 1005 of the steam cracking furnace 1003. The heated fluid stream in line 1031, upon exiting the convection section 1005, can be at a temperature in a range, e.g., from 300° C., 325° C., 375° C., or 425° C. to 450° C., 500° C., or 550° C. In some embodiments, the heated fluid stream in line 1031 can be in the gas phase, the liquid phase, or a mixed gas/liquid phase. The heated fluid stream in line 1031, upon introduction into the vessel 1020, can be at a temperature in a range, e.g., from 300° C., 350° C., or 400° C. to 425° C., 475° C., 525° C., or 550° C. In some embodiments, the heated fluid stream in line 1031 can provide sufficient heat to the vessel 1020 to facilitate the cracking of the plastic material in the heavy feed introduced via line 1001 under the plastic pyrolysis conditions.

A hydrocarbon feed in line 1007 can be heated within the convection section 1005 of the steam cracking furnace 1003. For example, the hydrocarbon feed in line 1007 can be heated in an internal heat exchanger 1008 and/or an internal heat exchanger 1014 disposed within the convection section 1005 of the steam cracking furnace 1003. The heat exchanger 1008 and/or 1014 can include a single pass or multiple passes through the convection section 1005 of the steam cracking furnace 1003. It should be understood that the convection section 1005 can be configured in any desired manner. In some embodiments, the convection section 1005 can also include one or more additional heat exchangers (not shown) that can be configured to heat boiler feed water to produce heated boiler feed water, steam, e.g., superheated steam, etc. There are many different configurations the convection section 1005 of the steam cracking furnace 1003 can be arranged in as will be appreciated by a person having ordinary skill in the art.

The hydrocarbon feed in line 1007 can be combined with an aqueous fluid in line 1011 to form a mixture. In some embodiments, the hydrocarbon feed in line 1007 can be heated before, during, and/or after the hydrocarbon feed in line 1007 is combined with the aqueous fluid in line 1011 to produce a heated mixture in line 1015 that includes hydrocarbons and steam. As shown in FIG. 1, the hydrocarbon feed in line 1007 can be initially heated within the internal heat exchanger 1008 disposed within the convection section 1005 to produce a heated hydrocarbon feed in line 1009, combined with the aqueous fluid in line 1011 to produce a mixture in line 1013, and the mixture in line 1013 can be heated within the internal heat exchanger 1014 to produce the heated mixture in line 1015. In other embodiments, however, a mixture that includes the hydrocarbon feed and an aqueous fluid can be introduced into the heat exchanger 1008. In still other embodiments, the aqueous fluid in line 1011 can be combined with the heated hydrocarbon feed in line 1015 to produce the heated mixture. The heated mixture in line 1015 can be at a temperature in a range, e.g., from 325° C., 375° C., or 425° C. to 450° C., 500° C., or 550° C. The heated mixture in line 1015 can be in the gas phase or can primarily be in the gas phase with a minor amount in the liquid phase. When a minor amount of the heated mixture in line 1015 is in the liquid phase, such minor amount can be up to about 5 wt %, 4 wt %, 3 wt %, 2 wt %, 1 wt %, 0.5 wt %, 0.1 wt %, or 0.01 wt %, based on the total weight of the heated mixture.

The heated mixture in line 1015 and the vapor phase effluent in line 1023 can be combined to produce a combined mixture in line 1033. The combined mixture in line 1033 can be heated within an internal heat exchanger 1035 disposed within the convection section 1005 to produce a heated combined mixture via line 1037. The heat exchanger 1035 can include a single pass or multiple passes through the convection section 1005 of the steam cracking furnace 1003. The heated combined mixture in line 1037 can be introduced into one or more radiant tubes 1039 disposed within a radiant section 1006 of the steam cracking furnace 1003 and steam cracked therein to produce a stream cracker effluent via line 1041. The steam cracker effluent in line 1041 can include, among other products, one or more olefins, steam cracker naphtha, steam cracker gas oil, steam cracker quench oil, steam cracker tar, or any mixture thereof. In certain embodiments, the heat exchanger 1035 can be located above the heat exchanger 1029 (as shown in FIG. 1) in the convection section 1005 to ensure that the fluid stream in line 1027 is heated in heat exchanger 1029 to a desired high temperature to effect plastic pyrolysis in vessel 2020 under the desired pyrolysis conditions. In other embodiments, the heat exchanger 1035 can be located below the heat exchanger 1029 (not shown) or at the same elevation as the heat exchanger 1029 (not shown) in the convection section.

The steam cracking conditions within the radiant section 1006 of the steam cracking furnace 1003 can include, but are not limited to, one or more of: exposing the heated combined mixture to a temperature (as measured at a radiant outlet of the steam cracker) of ≥400° C., e.g., a temperature of about 700° C., about 800° C., or about 900° C. to about 950° C., about 1,000° C., or about 1050° C., a pressure of about 100 kPa-absolute to about 600 kPa-absolute, and/or a steam cracking residence time of about 0.01 seconds to about 5 seconds. In some embodiments, the heated combined mixture can be steam cracked according to the processes and systems disclosed in U.S. Pat. Nos. 6,419,885; 7,993,435; 9,637,694; and 9,777,227; U.S. Patent Application Publication No. 2018/0170832; and International Patent Application Publication No. WO 2018/111574. The steam cracker effluent in line 1041, at an outlet of the radiant tube(s) 1039, can be at a temperature of ≥400° C., e.g., a temperature of about 700° C., about 800° C., or about 900° C. to about 950° C., about 1,000° C., or about 1050° C.

In some embodiments, the steam cracking furnace 1003 can include a plurality of internal heat exchangers 1035 and a plurality of radiant tubes 1039. Each internal heat exchanger 1035 can be in fluid communication with a corresponding radiant tube 1039 or two or more corresponding radiant tubes 1039 such that a plurality of separate "passes" through the convection section 1035 and the radiant section 1006 can be present within the steam cracking furnace 1003. One or more of the "passes" through the convection section 1035 can be configured to receive the combined mixture in line 1033 such that only some of the "passes" process the combined mixture in line 1033. Each individual "pass" through the convection section 1005 and the radiant section 1006 can be configured to process a unique feed that can be controlled independently from one another. As such, in some embodiments, the steam cracking furnace 1003 can process the combined mixture in line 1033 that includes one or more hydrocarbons produced by pyrolyzing the plastic material within the vessel 1020 in one or more "passes" while simultaneously processing one or more additional hydrocarbon feeds that do not contain the one or more hydrocarbons produced by pyrolyzing the plastic material within the vessel 1020 in one or more other "passes". For example, in some embodiments, a first portion of the heated mixture in line 1015 can be combined with the vapor phase effluent in line 1023 and a second portion of the heated mixture in line 1015 can be routed through another heat exchanger disposed within the convection section 1005 of the steam cracking furnace 1003 and then into one or more separate radiant tubes 1039 disposed within the radiant section 1006 of the steam cracking furnace 1003. In other examples, multiple hydrocarbon feeds having the same or different compositions can be heated with one or more hydrocarbon feeds being combined with the vapor phase effluent in line 1023 and one or more hydrocarbon feeds being processed separately, i.e., not combined with the vapor phase effluent in line 1023, within the radiant section 1006 of the steam cracking furnace 1003. The process conditions, e.g., flow rate, temperature, and/or pressure, within each of the one or more "passes" can be the same or different with respect to one another.

In some embodiments, during the start-up of the process/system 1000 (whether the first time or after a shutdown), heat can be transferred into the vessel 1020 via a heat exchanger, e.g., a steam jacket or internal heating tubes configured to carry steam or other heated medium therethrough, heating elements, a flue gas recovered from the steam cracking furnace 1003, and/or any other suitable heat source. In other embodiments, during the start-up of the process/system 1000, the heavy feed in line 1001 can have a sufficiently low viscosity that the heavy feed can be obtained via line 1021, transferred via line 1027 into and through the heat exchanger 1029 for heating, and then reintroduced via line 1031 into the vessel 1020. In still other embodiments, during the start-up of the process/system 1000, the heavy feed in line 1001 can be first heated within the convection section 1005 to produce a heated heavy feed that can be introduced into the vessel 1020. In still other embodiments, during the start-up of the process/system 1000, a carrier liquid can be heated within the convection section 1005, e.g., within heat exchanger 1029 and introduced into the vessel 1020, and the heavy hydrocarbon feed that can be or can include the plastic material can be added after one or more process conditions within the vessel 1020, e.g., a temperature with the vessel 1020, have reached a predetermined value(s).

In the processes illustrated in FIG. 1, by pumping the plastic-containing liquid stream 1027 and heating the same in exchanger 1029 in the convection section, unreacted plastic material and heavy molecules (such as heavy hydrocarbons) contained therein can be exposed to pyrolysis conditions in vessel 1020 a second, or even multiple times, effectively extending the residence time thereof to achieve the desired level of pyrolysis under the desired pyrolysis conditions such as a temperature without causing excessive coking in vessel 1020 and connected pump and conduit lines. The thermal energy entrained in the flue gas exiting the radiant section 1006 of the steam cracking furnace can be effectively and efficiently used to heat the fluid stream in exchanger 1029. Hydrocarbons such as $C_1$-$C_4$ gases and those boiling in naphtha boiling ranges exiting vessel 1020 in the vapor phase effluent 1023, which are highly suitable for steam cracking, can be combined with the heated mixture in line 1015 that includes hydrocarbons and steam, further heated, and then cracked in the radiant section 1006 of the steam cracking furnace 1003.

In the embodiment shown in FIG. 1 and the embodiments of other drawings described below, the vessel 1020 is shown to be connected with a single steam cracking furnace. It is further contemplated that, in certain preferred embodiments, the vessel 1020 may be connected with multiple steam cracking furnaces. For example, in one embodiment (not shown), a split stream of the liquid stream in line 1021 may be pumped and sent to a heat exchanger located in the convection section of a second steam cracker (not shown), where it is heated, and then returned into vessel 1020 after optionally being combined with the heated fluid stream in line 1031, or at a differing location on vessel 1020 than the entry point of line 1031. In another embodiment (not shown), a split stream of the vapor phase effluent in line 1023 may be fed into a second steam cracking furnace, optionally after being mixed with another hydrocarbon/steam stream, heated in the convection section of the second streaking furnace, and then fed into the radiant section of the second cracking furnace. Thus, the vessel 1020 can be configured to work simultaneously or alternately with two or more steam cracking furnaces. Such multiple steam cracking furnace arrangement can ensure continued plastic pyrolysis and steam cracking operation even if one steam cracking furnace stopped operation due to, e.g., decoking or other needs.

In the embodiment shown in FIG. 1 and the embodiments of other drawings described below, a single vessel 1020 is shown to be connected with a single steam cracking furnace. It is further contemplated that, in certain preferred embodiments, multiple vessels 1020, of the same, similar, of differing sizes and/or designs, may be connected with one or multiple steam cracking furnaces. For example, in one embodiment (not shown), one vessel 1020 can be designed and configured to accept a first type of heavy feed comprising a first plastic material, and a second vessel 1020 can be designed to accept a second type of heavy feed comprising a second plastic material which may be the same or different from the first plastic material. Where the first and second plastic materials differ, the two vessels 1020 can be operated under differing pyrolysis conditions to suit the needs of the differing plastic materials. The vapor effluent streams in lines 1023 exiting the two vessels 1020 can be combined and then fed into a steam cracking furnace optionally together with a hydrocarbon stream. The liquid effluent streams 1021 exiting the two vessels 1020, if differing substantially in terms of temperature and/or composition, may be separately pumped into separate heat exchangers in the convection section(s) of one or more steam cracking furnaces, and then returned to the same or different vessel 1020. Such embodiments including multiple vessels 1020 can have the advantage of being capable of handling multiple differing plastic materials requiring differing pyrolysis conditions.

It should be understood that the steam cracking furnace 1003 can be operated on all hydrocarbon feeds that can be processed in a steam cracking furnace. For example, the hydrocarbon feed can be operated exclusively on one or more hydrocarbons that are gaseous at room temperature, e.g., ethane, propane, and/or butane, one or more hydrocarbons that are liquid at room temperature, e.g., naphtha, one or more hydrocarbons that are solid at room temperature, e.g., heavy fractions obtained from a crude oil, or any combination or mixture thereof. It should also be understood that the steam cracking furnace 1003 may be operated to combust any fuel suitable for a steam cracking furnace to generate the thermal energy required for the pyrolysis of hydrocarbon molecules in the radiant section of the furnace. Such fuel can include, e.g., methane, natural gas, hydrogen, and mixtures thereof at any proportion.

Figure 2:
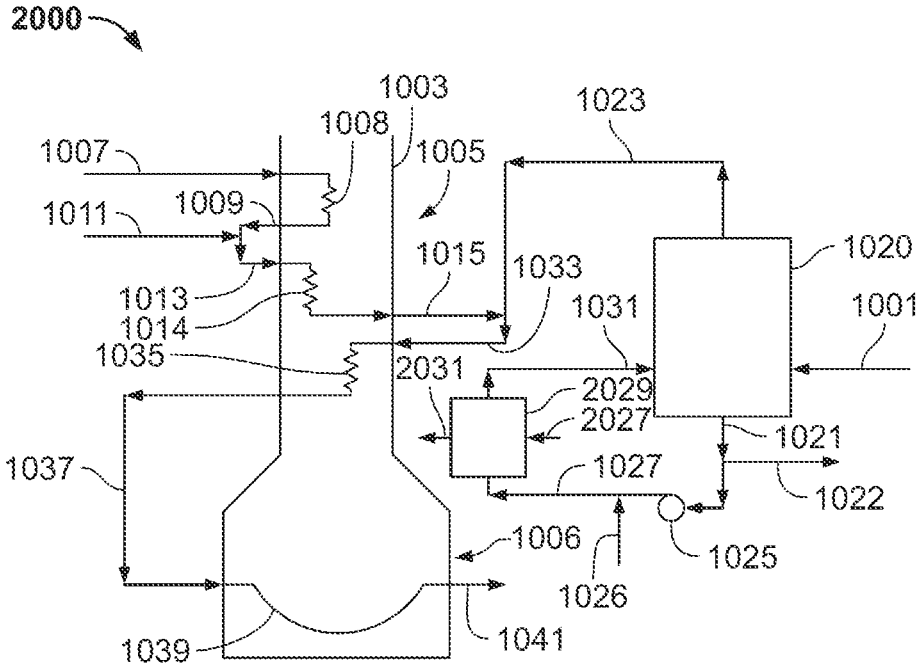
FIG. 2 depicts an illustrative process/system for steam cracking a mixture that includes a heated mixture of hydrocarbons and steam and a vapor phase effluent derived from a heavy feed containing a plastic material, which utilizes heat from an external heat exchanger to produce the vapor phase effluent, according to one or more embodiments described.

FIG. 2 depicts an illustrative process/system 2000 for steam cracking a mixture in line 1037 that includes a heated mixture of hydrocarbons and steam from line 1015 and a vapor phase effluent derived from a heavy feed containing a plastic material from line 1023, which utilizes heat from an external heat exchanger 2029 to produce the vapor phase effluent, according to one or more embodiments. The process/system 2000 is similar to the process/system 1000 described above with reference to FIG. 1. The main difference between the process/system 1000 and the process/system 2000 is that the process/system 2000 includes the one or more external heat exchangers 2029, as opposed to the one or more heat exchangers 1029 disposed within the convection section 1005 of the steam cracking furnace 1003.

A heated fluid medium via line 2027 can be introduced into the external heat exchanger 2029 and heat can be indirectly transferred from the heated fluid medium to the liquid phase effluent introduced via line 1027 into the heat exchanger 2029. A cooled fluid medium via line 2031 and the heated fluid stream via line 1031 can be recovered or otherwise obtained from the external heat exchanger 2029. In some embodiments, the heated fluid medium in line 2027 can be or can include, but is not limited to, one or more heated hydrocarbons, steam, a heated combustion or flue gas, a non-hydrocarbon fluid, e.g., liquid phase water, any combination thereof, or any mixture thereof. In some embodiments, the heated fluid medium in line 2027 can be heat-integrated with the steam cracking furnace 1003 as a convection section pass or a transfer line exchanger configured to cool the steam cracker effluent in line 1041. In some embodiments, the heated fluid medium in line 2027 can be or can include at least a portion of the steam cracker effluent in line 1041, which may or may not be subjected to one or more initial cooling steps prior to introduction via line 2027 into the external heat exchanger 2029. It should be understood that multiple external heat exchangers 2029 can be used and the heated fluid mediums in lines 2027 can have the same composition or different compositions as well as the same or different temperatures with respect to one another.

In other embodiments, the external heat exchanger 2029 can be heated via one or more electrical heating elements. For example, a radiant/conductive heat source can be disposed within the external heat exchanger 2029 that can be or can include one or more electric heating elements that can heat the liquid phase effluent introduced via line 1027 into the external heat exchanger 2029.

In some embodiments, in process/systems 1000 and/or 2000, the vessel 1020 can be taken offline while the steam cracking furnace 1003 continues processing the hydrocarbon feed in line 1007. For example, a valve can be closed to isolate line 1023 from line 1015, thereby allowing the heated mixture in line 1015 to flow into line 1033 alone without being combined with the vapor phase effluent in line 1023. Introduction of the heavy feed via line 1001 can also be stopped to bring the vessel 1020 offline. Taking the vessel 1020 offline can allow maintenance operations to be carried out while still continuing to process the hydrocarbon feed in line 1007. In other embodiments, the valve can be closed to isolate line 1023 from line 1015 to allow the heated mixture in line 1015 to flow into line 1033 alone, introduction of the heavy feed via line 1001 can be slowed or stopped, and at least a portion of the liquid phase effluent in line 1021 can continue to circulate through line 1027, into the heat exchanger 1029 and/or 2029, and back into the vessel 1020 via line 1031 to allow additional time for the plastic material to be cracked under the plastic pyrolysis conditions within the vessel 1020. As such, in some embodiments, the heavy feed in line 1001 can be processed in a batch type process rather than in a continuous type process. In some embodiments, if the overhead in line 1023 obtained from the vessel 1020 needs to be isolated from the furnace, the overhead in line 1023 can be routed to an alternate location, e.g., a flare tower, a process gas compressor, a recovery section, used as a fuel gas, etc., such that the heat exchanger 1029 and/or 2029 can remain online.

In some embodiments, another process/system similar to processes/systems 1000 and 2000 can utilize both the one or more heat exchangers 1029 disposed within the convection section 1005 of the steam cracking furnace 1003 and the one or more external heat exchangers 2029 to provide heat to the to the vessel 1020 via transferring heat to the liquid phase effluent in line 1027. It should also be understood that a process/system that utilizes both the heat exchanger 1029 and the external heat exchanger 2029 can be configured to serially heat the liquid phase effluent in line 1027 in either order or can be configured to heat separate streams of the liquid phase effluent.

With reference to FIGS. 1 and 2, the following components can also be referred to as follows. The internal heat exchangers 1008 and 1014 can also be referred to as one or more first heat exchangers. The heat exchangers 1029 and 2029 can also be referred to as one or more second heat exchangers. The heat exchanger 1035 can also be referred to as one or more third heat exchangers. Line 1021 can also be referred to as a first conduit and line 1023 can also be referred to as a second conduit. Line 1031 can be referred to as a recycle conduit. Line 1033 can also be referred to as a third conduit.

Figure 3:
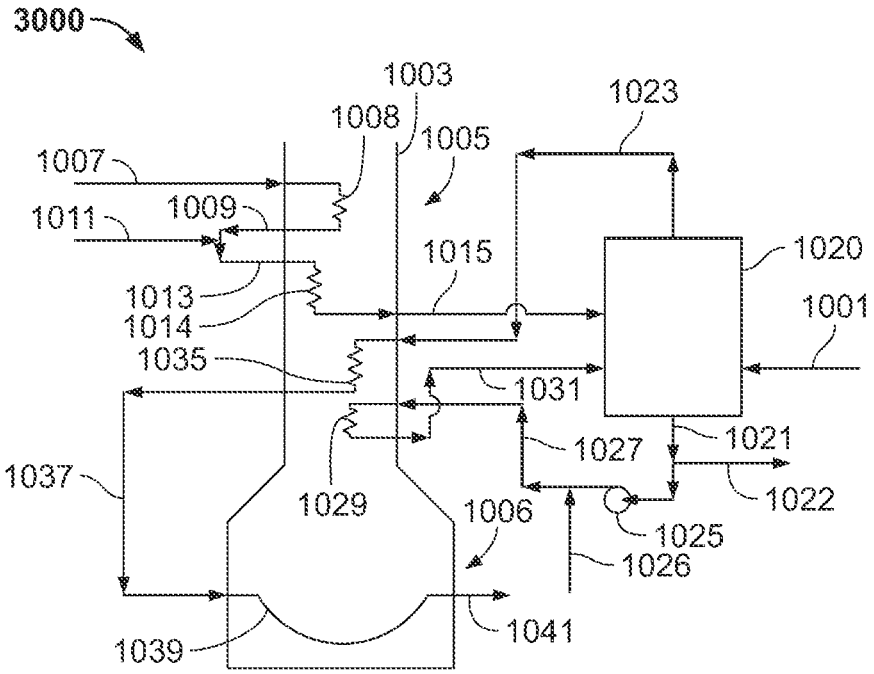
FIG. 3 depicts an illustrative process/system for steam cracking a heated vapor phase effluent recovered from a vessel, which utilizes heat from a convection section of a steam cracking furnace to pyrolyze at least a portion of a plastic material in a heavy feed introduced into the vessel 1020, according to one or more embodiments described.

FIG. 3 depicts an illustrative process/system 3000 for steam cracking a heated vapor phase effluent in line 1037 recovered from the vessel 1020 that utilizes heat from the convection section 1005 of the steam cracking furnace 1003 to pyrolyze at least a portion of the plastic material in the heavy feed introduced via line 1001 into the vessel 1020, according to one or more embodiments. The process/system 3000 is similar to the process/system 1000 described above with reference to FIG. 1. The main difference between the process/system 1000 and the process/system 3000 is that the process/system 3000 introduces the heated mixture in line 1015 into the vessel 1020. In such embodiment, the heated mixture in line 1015 can be completely in the liquid phase, can be completely in the gas phase, or can be a two-phase gas/liquid mixture. For example, a sufficiently heavy hydrocarbon feed in line 1007 can be heated within the convection section 1005 of the steam cracking furnace 1003 and combined with steam to produce the heated mixture in line 1015 that can be at least partially in the liquid phase. In some embodiments, the heated mixture in line 1015 can be at a temperature in a range, e.g., from 300° C., 325° C., 375° C., or 425° C. to 450° C., 500° C., or 550° C. In some embodiments, the two-phase gas/liquid heated mixture in line 1015 can include 0.1 wt %, 1 wt %, 10 wt %, 35 wt %, or 50 wt % to 60 wt %, 80 wt %, 90 wt %, 95 wt %, 99 wt %, or 99.1 wt % of hydrocarbons in the liquid phase, based on the total weight of the two-phase gas/liquid heated mixture. It should be understood that the addition of steam via line 1011 is optional. As such, steam may or may not be present in the two-phase gas/liquid mixture in line 1015.

As shown in FIG. 3, the heated mixture via line 1015 and the heavy feed via line 1001 can be introduced separately into the vessel 1020. In some embodiments, the heavy feed via line 1001 can be introduced into the vessel 1020 followed by the heated mixture via line 1015. In other embodiments, the heated mixture via line 1015 can be introduced into the vessel 1020 followed by the heavy feed via line 1001. In other embodiments, the heavy feed via line 1001 and the heated mixture via line 1015 can be co-fed simultaneously into the vessel 1020. In still other embodiments, the heated mixture in line 1015 and the heavy feed in line 1001 can be combined with one another to produce a mixed or combined feed that can be introduced into the vessel 1020.

The vapor phase effluent in line 1023 can include hydrocarbons derived from both the hydrocarbon feed in line 1007 and the plastic material in the heavy feed in line 1001. In some embodiments, introducing the heated two-phase gas/liquid mixture via line 1015 into the vessel 1020 can supplement or completely replace any need for the heavy feed in line 1001 or the liquid phase bottoms in line 1021 or 1027 to be mixed, blended, or otherwise contacted with a liquid medium such as the carrier liquid. The liquid phase component of the heated two-phase gas/liquid mixture in line 1015 can reduce the viscosity or otherwise improve the flow through dilution of the liquid phase effluent in lines 1021, 1027, 1031 sufficiently such that an additional liquid medium via line 1026 can be avoided. The heated two-phase gas/liquid mixture in line 1015 can also provide additional heat to the vessel 1023. As such, in some embodiments, the flow rate of the liquid phase effluent in line 1027 into the heat exchanger 1029 can be reduced as compared to the flow rate of the liquid phase effluent in line 1027 in the process/system 1000.

Figure 4:
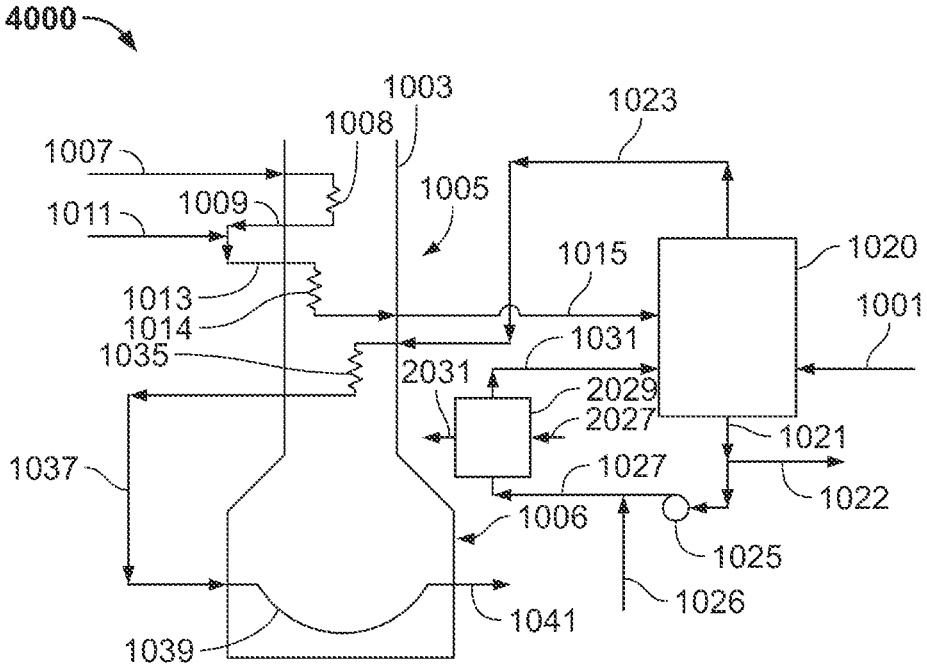
FIG. 4 depicts an illustrative process/system for steam cracking a heated vapor phase effluent recovered from a vessel, which utilizes heat from an external heat exchanger to pyrolyze at least a portion of a plastic material in a heavy feed introduced into the vessel, according to one or more embodiments described.

FIG. 4 depicts an illustrative process/system 4000 for steam cracking a heated vapor phase effluent in line 1023 recovered from the vessel 1020 that utilizes heat from an external heat exchanger 2029 to pyrolyze at least a portion of the plastic material in the heavy feed introduced via line 1001 into the vessel 1020, according to one or more embodiments. The process/system 4000 is similar to the process/system 3000 described above with reference to FIG. 3. The main difference between the process/system 3000 and the process/system 4000 is that the process/system 4000 includes the one or more external heat exchangers 2029, as opposed to the one or more heat exchangers 1029 disposed within the convection section 1005 of the steam cracking furnace 1003. As such, the process/system 4000 is also similar to the process/system 2000 described above with reference to FIG. 2 that also includes the external heat exchanger 2029. The main difference is that the heated mixture in line 1015 is introduced into the vessel 1020 as in the process/system 3000.

Similar to the process/system 3000, the heated mixture in line 1015 that can be introduced into the vessel 1020 can be a two-phase gas/liquid mixture. As such, a sufficiently heavy hydrocarbon feed in line 1007 can be heated within the convection section 1005 of the steam cracking furnace 1003 and combined with steam to produce the heated two-phase gas/liquid mixture in line 1015. Similar to the process/system 2000, the heated fluid medium via line 2027 can be introduced into the external heat exchanger 2029 and heat can be indirectly transferred from the heated fluid medium to the liquid phase effluent introduced via line 1027 into the heat exchanger 2029. Likewise the cooled fluid medium via line 2031 and the heated fluid stream via line 1031 can be recovered or otherwise obtained from the external heat exchanger 2029 and introduced into the vessel 1020.

As shown in FIG. 4, the heated mixture via line 1015 and the heavy feed via line 1001 can be introduced separately into the vessel 1020. In some embodiments, the heavy feed via line 1001 can be introduced into the vessel 1020 followed by the heated mixture via line 1015. In other embodiments, the heated mixture via line 1015 can be introduced into the vessel 1020 followed by the heavy feed via line 1001. In other embodiments, the heavy feed via line 1001 and the heated mixture via line 1015 can be co-fed simultaneously into the vessel 1020. In still other embodiments, the heated mixture in line 1015 and the heavy feed in line 1001 can be combined with one another to produce a mixed or combined feed that can be introduced into the vessel 1020.

With reference to FIGS. 3 and 4, the following components can also be referred to as follows. The internal heat exchangers 1008 and 1014 can also be referred to as one or more first heat exchangers. The heat exchangers 1029 and 2029 can also be referred to as one or more second heat exchangers. The heat exchanger 1035 can also be referred to as one or more third heat exchangers. Line 1021 can also be referred to as a first conduit and line 1023 can also be referred to as a second conduit. Line 1031 can also be referred to as a recycle conduit.

Figure 5:
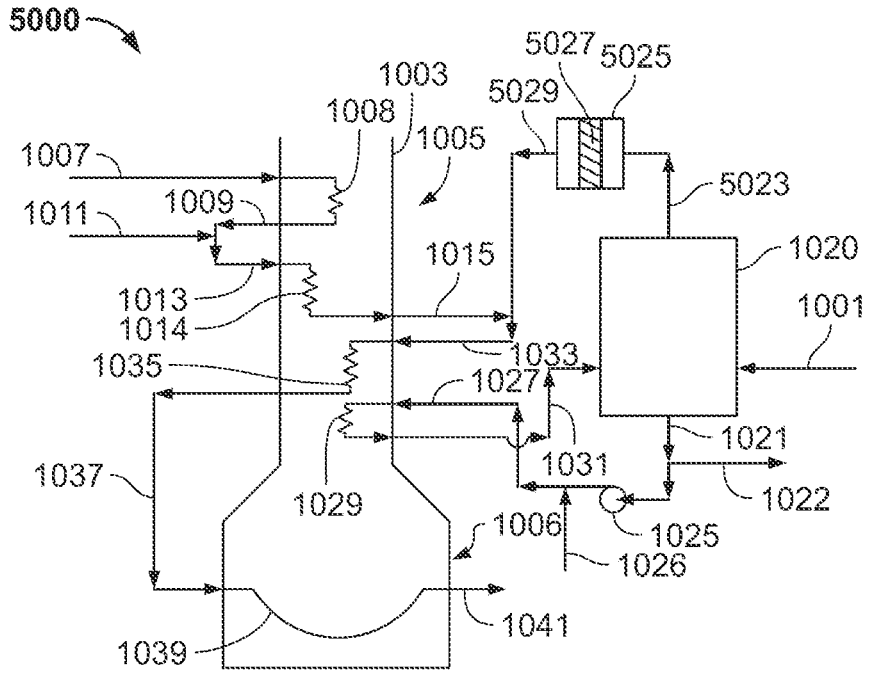
FIG. 5 depicts an illustrative process/system for pyrolyzing at least a portion of a heavy feed containing a plastic material to produce a vapor phase effluent that includes one or more contaminant-containing compounds and removing at least a portion of the contaminant-containing compound (s) therefrom, according to one or more embodiments described.

FIG. 5 depicts an illustrative process/system 5000 for pyrolyzing at least a portion of a heavy feed containing a plastic material in line 1001 to produce a vapor phase effluent via line 5023 that includes one or more contaminant-containing compounds and removing at least a portion of the contaminant-containing compound(s) therefrom, according to one or more embodiments. The process/system 5000 is similar to the process/system 1000 described above with reference to FIG. 1. The main difference is that the process/system 5000 further includes a contaminant removal unit 5025.

In some embodiments, the plastic material and/or any carrier liquid combined therewith that makes up the heavy feed in line 1001 can include one or more contaminants and/or include one or more compounds from which one or more contaminants can be produced therefrom once introduced into the vessel 1020. The contaminant removal unit can remove at least a portion of the contaminant to produce a contaminant-lean vapor phase stream. In some embodiments, the plastic material and/or any carrier liquid combined therewith that makes up the heavy feed in line 1001 can include one or more compounds that include one or more halogen atoms, e.g., chlorine, fluorine, bromine, or a mixture thereof. For example, the plastic material can be or can include one or more halide-containing polymers and/or the plastic material can include one or more halide containing compounds disposed thereon. In such embodiment, the vapor phase effluent recovered via line 5023 from the vessel 1020 can include one or more halide-containing compounds, e.g., HCl. In some embodiments, it can be desirable to remove at least a portion of the one or more halide-containing compounds when such compounds are present from the vapor phase effluent in line 5023. As such, in some embodiments, the vapor phase effluent in line 5023 can be introduced into the contaminant removal unit (in this example a halide removal unit) 5025 and contacted with one or more guard beds 5027 disposed therein to remove at least a portion of the halide-containing compounds to produce a halide-lean vapor phase stream via line 5029. Examples of suitable materials that can be used to make-up the guard bed 5027 can be or can include, but are not limited to, alkaline or basic oxides such as calcium oxide, magnesium oxide, zinc oxide, or any mixture thereof. In some embodiments, suitable processes/systems for removing contaminants can include those disclosed in U.S. Provisional Patent Application No. 63/301,079. The halide-lean vapor phase stream in line 5029 can be combined with the heated mixture in line 1015 to produce the combined mixture in line 1033 that can be further heated in the heat exchanger 1035 and introduced via line 1037 into the one or more radiant tubes 1039 to produce the steam cracker effluent via line 1041.

Figure 6:
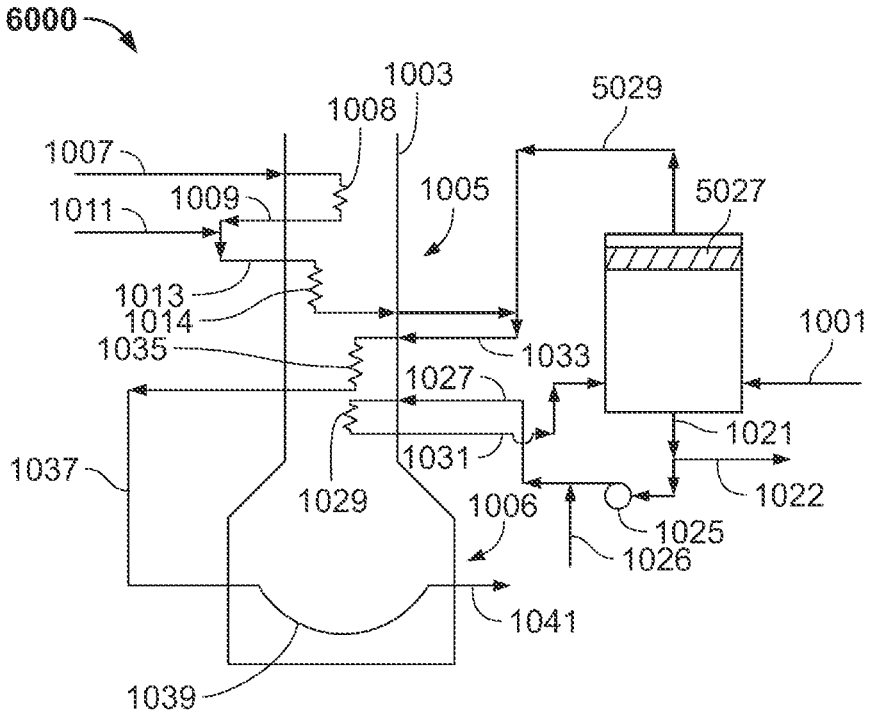
FIG. 6 depicts another illustrative process/system for pyrolyzing at least a portion of a heavy feed containing a plastic material to produce a vapor phase effluent that includes one or more contaminant-containing compounds and removing at least a portion of the contaminant-containing compound(s) therefrom, according to one or more embodiments described.

FIG. 6 depicts another illustrative process/system 6000 for pyrolyzing at least a portion of a heavy feed containing a plastic material in line 1001 to produce a vapor phase effluent that includes one or more halide-containing compounds and removing at least a portion of the halide-containing compound(s) therefrom, according to one or more embodiments. The process/system 6000 is similar to the process/system 5000. The main difference is that rather than having the one or more guard beds 5027 disposed within a separate contaminant removal unit 5025, the one or more guard beds 5027 can be disposed within the vessel 1020. As such, the halide-lean vapor phase stream can be recovered via line 5029 from the vessel 1020, combined with the heated mixture in line 1015 to produce the combined mixture in line 1033 that can be further heated in the heat exchanger 1035 and introduced via line 1037 into the one or more radiant tubes 1039 to produce a steam cracker effluent via line 1041.

In other embodiments, the vapor phase effluent can include ammonia. In addition to nitrogen-containing polymers such as polyamines, various types of polymer additives can also include nitrogen. In the plastic pyrolysis conditions within the vessel 1020, at least a portion of the nitrogen can be converted to ammonia. As such, in other embodiments, another type of guard bed 5027 can be a guard bed configured to remove at least a portion of any ammonia that may be present in the vapor phase effluent in line 5023 (FIG. 5) and/or within the vessel 1020 (FIG. 6). Various types of adsorbents are available for the removal of ammonia, such as molecular sieve-based adsorbents.

In still other embodiments, the vapor phase effluent can include mercury. The plastic pyrolysis conditions within the vessel 1020 can convert at least a portion of any mercury present in the heavy feed and/or the hydrocarbon feed into elemental mercury if the heated mixture in line 1015 is introduced into the vessel 1020. As such, in other embodiments, another type of guard bed 5027 can be a guard bed configured to remove at least a portion of any mercury that may be present in the vapor phase effluent in line 5023 (FIG. 5) and/or within the vessel 1020 (FIG. 6). Such elemental mercury can be removed using a mercury removal guard bed. It is noted that some guard beds suitable for mercury removal can also be suitable for silicon removal. Examples of such guard beds can include, but are not limited to, refractory oxides with transition metals optionally supported on the surface, such as the oxides and metals used in demetallization catalysts or a spent hydrotreating catalysts. Additionally, separate guard beds can be used for silicon and mercury removal, or separate adsorbents for silicon removal and mercury removal can be included in a single guard bed. Examples of suitable mercury adsorbents and silicon adsorbents can be or can include, but are not limited to, molecular sieves that are suitable for adsorption of mercury and/or silicon. In some embodiments, two or more separate guard beds 5027 can be used for halide, ammonia, mercury, and/or silicon removal or separate materials configured to remove one or more of a halide, ammonia, mercury, and/or silicon can be included in a single guard bed 5027. While the guard bed 5207 has been described with reference to solid adsorbents, it should be understood that one or more guard beds 5027 can be or can include one or more non-solid guard beds such as a wash drum/vessel that can be configured for amine treating, caustic treating, and/or other treating. In some embodiments, one or more guard beds 5027 can be incorporated into one or more of the processes/systems 2000, 3000, 4000, 7000, 8000, 9000, and 10000 described herein.

Figure 7:
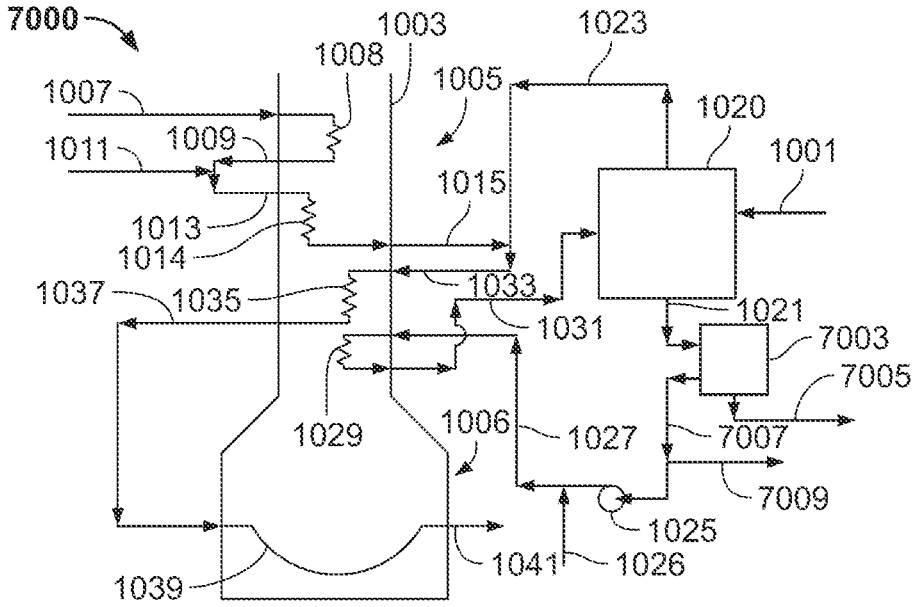
FIG. 7 depicts an illustrative process/system for pyrolyzing at least a portion of a heavy feed containing a plastic material that produces a liquid phase effluent containing char and separating at least a portion of the char therefrom, according to one or more embodiments described.
Figure 8:
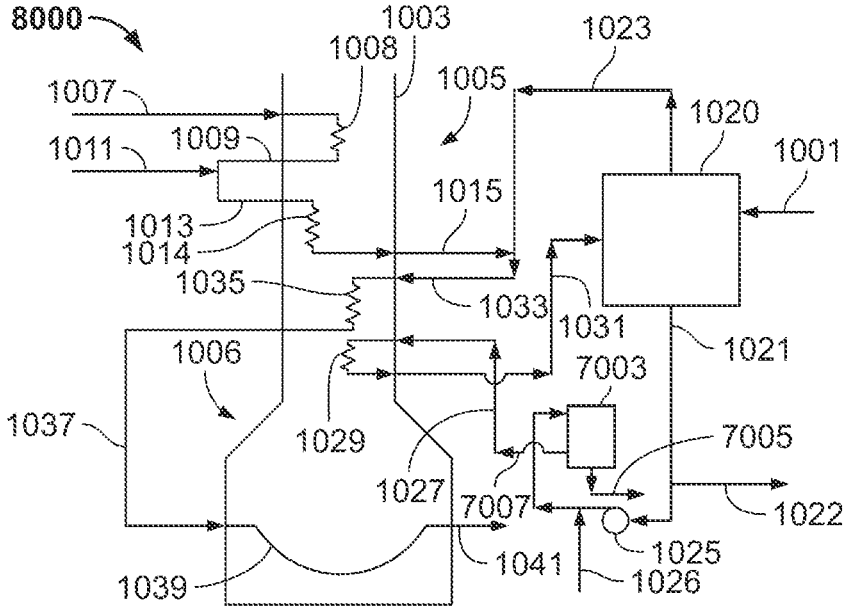
FIG. 8 depicts another illustrative process/system for pyrolyzing at least a portion of a heavy feed containing a plastic material that produces a liquid phase effluent containing char and separating at least a portion of the char therefrom, according to one or more embodiments described.

FIG. 7 depicts an illustrative process/system 7000 for pyrolyzing at least a portion of a heavy feed containing a plastic material in line 1001 that produces a liquid phase effluent containing char via line 1021 and separating at least a portion of the char therefrom, according to one or more embodiments. FIG. 8 depicts another illustrative process/system 8000 for pyrolyzing at least a portion of a heavy feed containing a plastic material in line 1001 that produces a liquid phase effluent via line 1021 containing char and separating at least a portion of the char therefrom, according to one or more embodiments. Processes/systems 7000 and 8000 are similar to process/system 1000, with the main difference being that the processes/systems 7000 and 8000 further include one or more separation vessels 7003 configured to remove at least a portion of the char from the liquid phase effluent in line 1021. In some embodiments, the processes/systems 7000 and/or 8000 may be preferred embodiments for plastic material that produces a significant amount of ash/char. Such high ash/char producing plastics can include, for example, artificial turf that typically includes non-plastic filler materials such as sand, plastic bags, or feeds that contain a significant amount of surface contamination.

Depending, at least in part, on the composition of the heavy feed in line 1001, e.g., the type and amount of plastic material contained in the heavy feed, a greater amount of char can be produced within the vessel 1020 that can be present in the liquid phase effluent in line 1021. As such, in some embodiments, the amount of char present in the liquid phase effluent in line 1021 in processes/systems 7000 and 8000 can be sufficiently high such that more char than is desired can remain in the liquid phase effluent in line 1027 that is further heated and reintroduced via line 1031 into the vessel 1020 as compared to process/system 1000. In such embodiment, one or more additional separation vessels 7003 can be used to increase the amount of the char separated from the liquid phase effluent in line 1021. At least a portion of the liquid phase effluent in line 1021 can be introduced into the separation vessel(s) 7003 to produce a char-rich stream via line 7005 and a char-lean stream via line 7007.

As shown in FIGS. 7 and 8, the char-rich stream via line 7005 can be removed and at least a portion of the char-lean stream in line 7007 can be introduced into line 1027 and heated within the heat exchanger 1029 disposed within the convection section 1005 of the steam cracking furnace 1003 to produce the heated fluid stream in line 1031 that can be introduced into the vessel 1020. As shown in FIG. 7, the separation vessel 7003 can be located between the vessel 1020 and the pump 1025. As shown in FIG. 8, the separation vessel 7003 can be located between the pump 1025 and the heat exchanger 1029 disposed within the convection section 1005 of the steam cracking furnace 1020. It should be understood that one or more separation vessels 7003 can be disposed upstream of the pump 1025 and/or one or more separation vessels 7003 can be disposed downstream of the pump 1025.

The separation vessel 7003 can be or can include any separation device configured to remove at least a portion of any char and, if present, at least a portion of any other solid(s) from the liquid phase effluent in line 1021. Illustrative separation vessels 7003 can include, but are not limited to, centrifuge(s), filter(s), settling drum(s), flash drum(s) ballistic separation, cyclone(s) or any combination thereof. Suitable separation vessels 7003 can include those described in U.S. Pat. Nos.: 6,376,732; 7,311,746; 7,427,381; 7,767,008; and 7,481,871. In some embodiments, one or more of the separation vessels 7003 can also be incorporated into any one of the processes/systems 2000, 3000, 4000, 5000, 6000, 9000, and/or 10000 described herein.

With reference to FIGS. 5-8, the following components can also be referred to as follows. The internal heat exchangers 1008 and 1014 can also be referred to as one or more first heat exchangers. The heat exchangers 1029 and 2029 can also be referred to as one or more second heat exchangers. The heat exchanger 1035 can also be referred to as one or more third heat exchangers. Line 1021 can also be referred to as a first conduit and line 1023 can also be referred to as a second conduit. Line 1031 can be referred to as a recycle conduit. Line 1033 can also be referred to as a third conduit.

Figure 9:
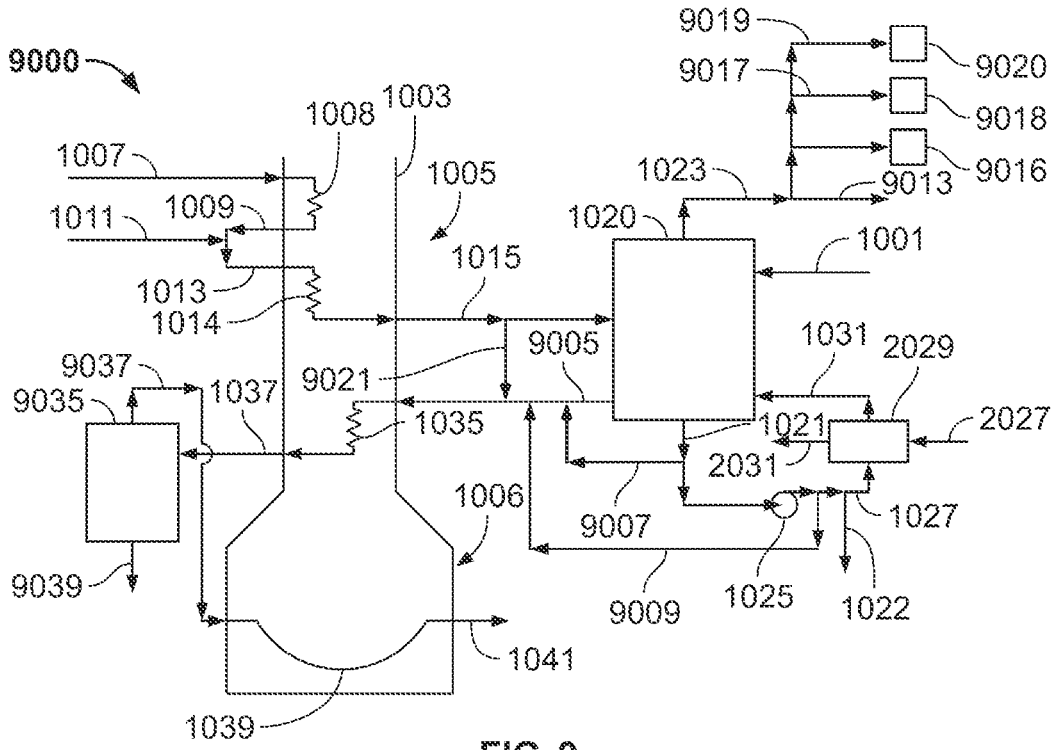
FIG. 9 depicts an illustrative process/system for the continuous or batch processing of a heavy feed containing a plastic material in a steam cracking furnace, according to one or more embodiments described.

FIG. 9 depicts an illustrative process/system 9000 for the continuous or batch processing of a heavy feed containing a plastic material in line 1001 in a steam cracking furnace 1003, according to one or more embodiments. The process/system 9000 is similar to the process/system 4000 with a few main differences. As in the process/system 4000, the heated mixture in line 1015 can be fully in the liquid phase or can be a two-phase gas/liquid mixture and at least a portion of the heated mixture in line 1015 can be introduced into the vessel 1020.

The first main difference is that the process/system 9000 can be configured to obtain a first liquid phase effluent via 1027 and a second liquid phase effluent via line 9005, 9007, and/or 9009 from the vessel 1020. As shown, in some embodiments, the first liquid phase effluent in line 1027 and the second liquid phase effluent inline 9005 can be obtained as separate streams from the vessel 1020. As such, in some embodiments, the first liquid phase effluent in line 1027 and the second liquid phase effluent in line 9005 can have the same or different composition. For example, in some embodiments, the first liquid phase effluent in line 1027 can include a greater amount of char than the second liquid phase effluent in line 9005. As also shown, in some embodiments, the first liquid phase effluent in line 1027 and the second liquid phase effluent in line 9007 and/or 9009 can be obtained from a single stream in line 1021 obtained from the vessel 1020. As such, in other embodiments, the first liquid phase effluent in line 1027 and the second liquid phase effluent in line 9007 and/or 9009 can have substantially the same composition as compared to one another.

The first liquid phase effluent in line 1027 can be heated within the external heat exchanger 2029 to produce the heated first fluid stream via line 1031 that can be recycled to the vessel 1020. The second liquid phase effluent in line 9005, 9007, and/or 9009 can be heated within the heat exchanger 1035 disposed within the convection section 1005 of the steam cracking furnace 1003 to produce a heated second fluid stream via line 1037.

The heated second fluid stream in line 1037 can be a gas/liquid phase mixture. As such, a second difference is that the process/system 9000 can be configured to obtain a vapor phase overhead via line 9037 and a liquid phase bottoms via line 9039 by introducing the heated second fluid stream in line 1037 into a separation drum 9035. The separation drum 9035 can also be referred to as a vapor-liquid separator, vaporization drum, or flash drum. In some embodiments, the liquid phase bottoms in line 9039 can have a cutoff point of from 300° C. to 700° C., e.g., 310° C. to 550° C., as measured according to ASTM D1160-18, ASTM D-86-20b, or ASTM D2887-19ae2. Conventional separation drums can be utilized to do this, though the invention is not limited thereto. Examples of such conventional separation drums can include those disclosed in U.S. Pat. Nos. 7,097,758; 7,138,047; 7,220,887; 7,235,705; 7,244,871; 7,247,765; 7,297,833; 7,311,746; 7,312,371; 7,351,872; 7,427,381; 7,488,459; 7,578,929; 7,674,366; 7,767,008; 7,820,035; 7,993,435; 8,105,479; and 9,777,227.

The vapor phase overhead via line 9037 can be introduced into the radiant tube(s) 1029 disposed within the radiant section 1006 of the steam cracking furnace 1003 and steam cracked therein to produce the steam cracker effluent via line 1041. In some embodiments, at least portion of the liquid phase bottoms via line 9039 can be recycled to the vessel 1020 and further subjected to the plastic pyrolysis conditions therein. In other embodiments, at least a portion of the liquid phase bottoms via line 9039 can be recycled to the hydrocarbon feed in line 1007 such that the liquid phase bottoms can make up at least a portion of the hydrocarbon feed in line 1007. In other embodiments, at least a portion of the liquid phase bottoms in line 9039 can be used as the carrier liquid that can be present in the heavy feed in line 1001 and/or added combined with the liquid bottoms recovered from the vessel 1020. In other embodiments, at least a portion of the liquid phase bottoms in line 9039 can be removed from the process/system 9000 and further processed in one or more other refinery, chemical, or other petrochemical operations and/or separated out into two or more products.

In some embodiments, the vapor phase effluent in line 1023 recovered from the vessel 1020 can be recycled via line 9013 to make up a portion of the hydrocarbon feed in line 1007, introduced via line 9015 into a gas recovery unit 9016, introduced via line 9017 into a primary fractionator 9018 that can be configured to also receive at least a portion of the steam cracker effluent in line 1041, introduced via line 9019 into a process gas compressor system, or any combination thereof.

In some embodiments, the heavy feed in line 1001 can include a halide element such as fluorine, chlorine, bromine, and combinations thereof. Such halide (e.g., chlorine) can be introduced into the heavy feed as an additive or contaminant to the plastic material. Alternatively, the plastic material (e.g., polyvinyl chloride) may be produced from a halide-containing monomer (e.g., vinyl chloride). In such embodiments, the plastic pyrolysis conditions within the vessel 1020 can be chosen such that at least a portion, preferably a majority, preferably ≥60 wt %, preferably ≥80 wt %, preferably ≥90 wt %, preferably substantially all, of the halide (e.g., chlorine) contained in the plastic material, based on the total weight of the halide therein, is converted into halide-containing compounds in the vapor phase effluent that exits the vessel 1020 in line 1023. Likewise, nitrogen, mercury, and/or silicon maybe present in the heavy feed in certain embodiments, which can be partly or wholly converted into ammonia, other n-containing compounds, mercury-containing compounds, and silicon-containing compounds in the vapor phase effluent that exits the vessel 1020 in line 1023. Thus, preferably, in these embodiments, the vapor phase effluent in line 1023 can be contacted with one or more guard beds as described above with reference to FIGS. 5 and 6 to abate the halide-containing compounds, ammonia or other nitrogen-containing compounds, mercury-containing compounds, and silicon-containing compounds.

In some embodiments, the heavy feed in line 1001 can be processed batchwise as opposed to a continuous process. In such embodiment, the introduction of the heavy feed in line 1001 and the introduction of the heated mixture via line 1015 into the vessel 1020 can be periodically stopped and recovery of the second portion of the liquid phase effluent via line 9005, 9007, and/or 9009 from the vessel 1020 can be periodically stopped. The heated mixture in line 1015 can be re-routed via line 9021 into the heat exchanger 1035 disposed within the convection section 1005 of the steam cracking furnace 1003 such that the heated mixture in line 1015 alone is steam cracked within the radiant section 1006 of the steam cracking furnace 1003. In some embodiments, the heated mixture in line 9021 can be used to dilute the liquid phase effluent in line 9005, 9007, or 9009. In some embodiments, during the periodic stopping of the introduction of the heavy feed via line 1001 and the heated mixture via line 1015 into the vessel 1020 and the recovery of the second portion of the liquid phase effluent via line 9005, 9007, and/or 9009, the heavy feed present within the vessel 1020 can continue to undergo cracking within the vessel 1020 under the plastic pyrolysis conditions. In other embodiments, during the periodic stopping of the introduction of the heavy feed via line 1001 and the heated mixture via line 1015 into the vessel 1020 and the recovery of the second portion of the liquid phase effluent via line 9005, 9007, and/or 9009, the vessel 1020 can be subjected to any required cleaning and/or maintenance, e.g., removal of char that may build-up from within the vessel 1020.

In some embodiments, the heavy feed via line 1001 can be introduced into the vessel 1020 followed by the heated mixture via line 1015. In other embodiments, the heated mixture via line 1015 can be introduced into the vessel 1020 followed by the heavy feed via line 1001. In still other embodiments, the heavy feed in line 1001 and the heated mixture in line 1015 can be combed with one another and introduced as a mixture into the vessel 1020. In yet other embodiments, the heavy feed via line 1001 and the heated mixture via line 1015 can be separately co-fed simultaneously into the vessel 1020.

Figure 10:
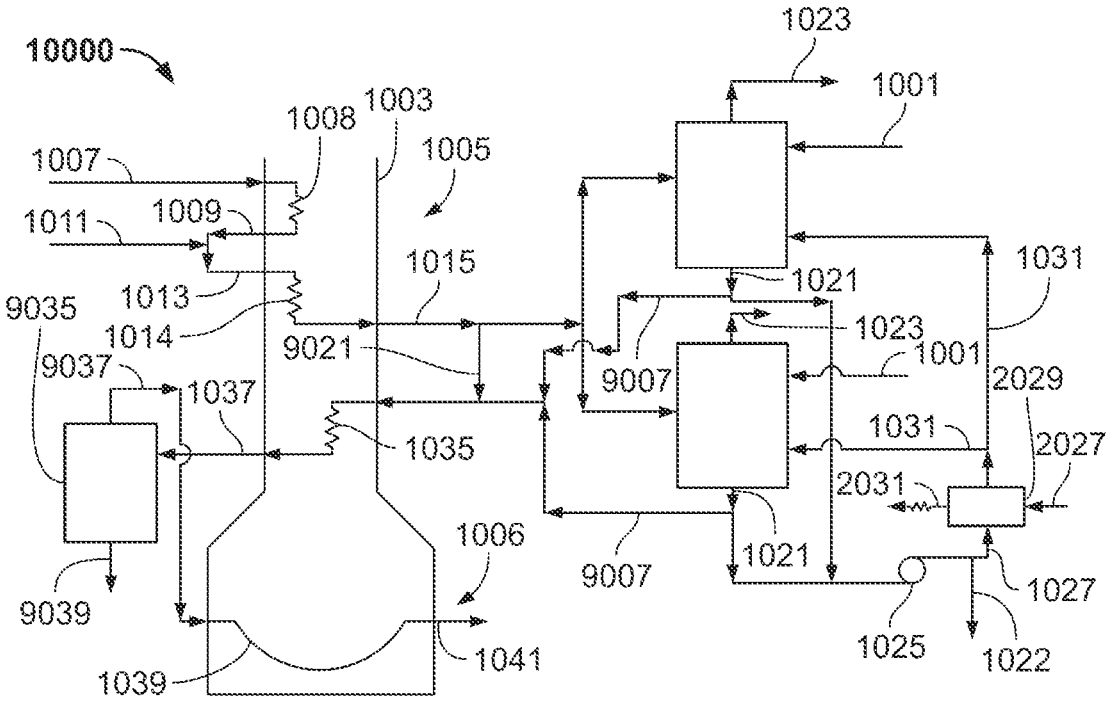
FIG. 10 depicts an illustrative process/system for the batch processing of a heavy feed containing a plastic material in a steam cracking furnace, which utilizes two or more plastic pyrolysis vessels, according to one or more embodiments described.

FIG. 10 depicts an illustrative process/system 10000 for the batch processing of the heavy feed containing the plastic material in line 1001 in a steam cracking furnace 1003 that utilizes two or more plastic pyrolysis vessels 1020, according to one or more embodiments. The process/system 10000 is similar to process/system 9000, with the main difference being the inclusion of at least two vessels 1020. One of the vessels 1020 can feed the steam cracking furnace 1003 with the second liquid phase effluent via line 9007 while the other vessel 1020 subjects the heavy feed in line 1001 to pyrolysis conditions. In other embodiments, the second liquid phase effluent can include the second liquid phase effluent via line 9005 and/or 9009 instead of or in addition to the second liquid phase effluent via line 9005. The vessels 1020 can cycle between feeding the steam cracking furnace 1003 and pyrolyzing the plastic material in the heavy feed.

In some embodiments, when one or both of the vessels 1020 need to undergo maintenance the process/system 10000 can continue to operate with one of the vessels 1020 offline or both of the vessels 1020 offline as described above with reference to FIG. 9. As such, when both vessels 1020 are taken offline for cleaning and/or maintenance the heated mixture in line 1015 can be directed via line 9021 to the steam cracking furnace 1003 such that the heated mixture alone is steam cracked within the radiant section 1006 of the steam cracking furnace 1003.

In some embodiments, the vapor phase effluent in line 1023 recovered from the vessel 1020 can be recycled to make up a portion of the hydrocarbon feed in line 1007, introduced into a gas recovery unit and/or a primary fractionator that can be configured to also receive at least a portion of the steam cracker effluent in line 1041, other disposition such as a vent gas system or flare, can be used as fuel for the steam cracking furnace 1003, or any combination thereof. It should be understood, that in some embodiments, the separation drum 9035 and/or multiple vessels 1020 can be incorporated into any one or more of processes/systems 1000, 2000, 3000, 4000, 5000, 6000, 7000, 8000, 9000 described herein.

With reference to FIGS. 9 and 10, the following components can also be referred to as follows. The internal heat exchangers 1008 and 1014 can also be referred to as one or more first heat exchangers. The heat exchangers 1029 and 2029 can also be referred to as one or more second heat exchangers. The heat exchanger 1035 can also be referred to as one or more third heat exchangers. Line 1021 can be referred to as a first conduit, any one or more of lines 9005, 9007, and 9009 can also be referred to as a second conduit, and line 1023 can be referred to as a third conduit. Line 1031 can also be referred to as a recycle conduit. Line 9039 can also be referred to as a liquid phase bottoms recycle conduit.

LISTING OF EMBODIMENTS

This disclosure may further include the following non-limiting embodiments.

A1. A system for converting hydrocarbons by pyrolysis, comprising: one or more first heat exchangers disposed within a convection section of a steam cracking furnace configured to heat a hydrocarbon feed or a hydrocarbon feed combined with an aqueous fluid to produce a heated mixture comprising hydrocarbons and steam, wherein the heating is configured to be carried out before, during, and/or after the hydrocarbon feed is combined with the aqueous fluid; a vessel configured to receive a heavy feed comprising a plastic material and to crack a portion of the plastic material therein under plastic pyrolysis conditions; a first conduit configured to obtain a liquid phase effluent and a second conduit configured to obtain a vapor phase effluent exiting the vessel; one or more second heat exchangers configured to heat at least a portion of the liquid phase effluent in the first conduit to produce a heated fluid stream; a recycle conduit in fluid communication with the one or more second heat exchangers configured to recycle at least a portion of the heated fluid stream to the vessel; a third conduit configured to receive the vapor phase effluent and the heated mixture to produce a combined mixture; one or more third heat exchangers disposed within the convection section of the steam cracking furnace configured to heat the combined mixture to produce a heated combined mixture; and one or more radiant tubes disposed within a radiant section of the steam cracking furnace configured to receive and steam crack at least a portion of the heated combined mixture therein to produce a steam cracker effluent comprising olefins.

A2. The system of A1, wherein at least one of the one or more second heat exchangers is disposed within the convection section of the steam cracking furnace.

A3. The system of A1 or A2, wherein at least one of the one or more second heat exchangers is an external heat exchanger located outside of the steam cracking furnace.

A4. The system of A3, wherein the external heat exchanger is configured to: transfer heat from a heated hydrocarbon, a heated aqueous medium, or a combination thereof, or transfer heat from one or more electrical heating elements, or a combination thereof to the at least a portion of the liquid phase effluent in the first conduit to produce the heated fluid stream.

A5. The system of any one of A1 to A4, further comprising a carrier liquid conduit configured to combine a carrier liquid with at least a portion of the liquid phase effluent in the first conduit to produce a combined liquid phase mixture.

A6. The system of any one of A1 to A5, further comprising a guard bed configured to contact the vapor phase effluent to remove at least a portion of any halide-containing compounds, at least a portion of any ammonia or other nitrogen-containing compounds, at least a portion of any mercury or mercury-containing compounds, at least a portion of any silicon or silicon-containing compounds, or any combination thereof to produce a contaminant-lean vapor phase stream.

A7. The system of A6, wherein the guard bed is located within the vessel.

A8. The system of A6, wherein the guard bed is located within a contaminant removal unit in fluid communication with the second conduit, the contaminant removal unit configured to receive the vapor phase effluent.

A9. The system of any one of A1 to A8, further comprising a separation vessel in fluid communication with the first conduit configured to receive at least a portion of the liquid phase effluent and to separate at least a portion of any char therefrom to produce a char-lean liquid phase effluent.

A10. The system of A9, wherein the one or more second heat exchangers are configured to receive and heat at least a portion of the char-lean liquid phase effluent to produce the heated fluid stream.

A11. The system of A9 or A10, wherein the separation vessel is located between the vessel and a pump, and wherein the pump is configured to convey the char-lean liquid phase effluent into the one or more second heat exchangers.

A12. The system of A9 or A10, wherein the separation vessel is located between a pump and the second heat exchanger, and wherein the pump is configured to convey the liquid phase effluent into the separation vessel.

B1. A system for converting hydrocarbons by pyrolysis, comprising: one or more first heat exchangers disposed within a convection section of a steam cracking furnace configured to heat a hydrocarbon feed or a hydrocarbon feed combined with an aqueous fluid to produce a heated mixture comprising hydrocarbons and steam, wherein the heating is configured to be carried out before, during, and/or after the hydrocarbon feed is combined with the aqueous fluid, and wherein the heated mixture is configured to be a two-phase gas/liquid mixture; a vessel configured to receive the heated mixture and a heavy feed comprising a plastic material and to crack a portion of the plastic material therein under plastic pyrolysis conditions; a first conduit configured to obtain a liquid phase effluent and a second conduit configured to obtain a vapor phase effluent exiting the vessel; one or more second heat exchangers configured to heat at least a portion of the liquid phase effluent in the first conduit to produce a heated fluid stream; a recycle conduit in fluid communication with the one or more second heat exchangers configured to recycle at least a portion of the heated fluid stream to the vessel; one or more third heat exchangers disposed within the convection section of the steam cracking furnace configured to heat the vapor phase effluent to produce a heated vapor phase effluent; and one or more radiant tubes disposed within a radiant section of the steam cracking furnace configured to receive and steam crack at least a portion of the heated vapor phase effluent to produce a steam cracker effluent comprising olefins.

B2. The system of B1, wherein at least one of the one or more second heat exchangers is disposed within the convection section of the steam cracking furnace.

B3. The system of B1 or B2, wherein at least one of the one or more second heat exchangers is an external heat exchanger located outside of the steam cracking furnace.

B4. The system of B3, wherein the external heat exchanger is configured to transfer heat from a heated hydrocarbon, a heated aqueous fluid, or a combination thereof, or transfer heat from one or more electrical heating elements, or a combination thereof to the at least a portion of the liquid phase effluent in the first conduit to produce the heated fluid stream.

B5. The system of any one of B1 to B4, further comprising a carrier liquid conduit configured to combine a carrier liquid with at least a portion of the liquid phase effluent in the first conduit to produce a combined liquid phase mixture.

B6. The system of any one of B1 to B5, further comprising a guard bed configured to contact the vapor phase effluent to remove at least a portion of any halide-containing compounds, at least a portion of any ammonia or other nitrogen-containing compounds, at least a portion of any mercury or mercury-containing compounds, at least a portion of any silicon or silicon-containing compounds, or any combination thereof to produce a contaminant-lean vapor phase stream.

B7. The system of B6, wherein the guard bed is located within the vessel.

B8. The system of B6, wherein the guard bed is located within a contaminant removal unit in fluid communication with the second conduit, the contaminant removal unit configured to receive the vapor phase effluent.

B9. The system of any one of B1 to B8, further comprising a separation vessel in fluid communication with the first conduit configured to receive at least a portion of the liquid phase effluent and to separate at least a portion of any char therefrom to produce a char-lean liquid phase effluent.

B10. The system of B9, wherein the one or more second heat exchangers are configured to receive and heat at least a portion of the char-lean liquid phase effluent to produce the heated fluid stream.

B11. The system of B9 or B10, wherein the separation vessel is located between the vessel and a pump, and wherein the pump is configured to convey the char-lean liquid phase effluent into the one or more second heat exchangers.

B12. The system of B9 or B10, wherein the separation vessel is located between a pump and the second heat exchanger, and wherein the pump is configured to convey the liquid phase effluent into the separation vessel.

C1. A system for converting hydrocarbons by pyrolysis, comprising: one or more first heat exchangers disposed within a convection section of a steam cracking furnace configured to heat a hydrocarbon feed or a hydrocarbon feed combined with an aqueous fluid to produce a heated mixture comprising hydrocarbons and steam, wherein the heating is configured to be carried out before, during, and/or after the hydrocarbon feed is combined with the aqueous fluid, and wherein the heated mixture is configured to be a two-phase gas/liquid mixture; a vessel configured to receive the heated mixture and a heavy feed comprising a plastic material and to crack a portion of the plastic material therein under plastic pyrolysis conditions; a first conduit configured to obtain a first liquid phase effluent, a second conduit configured to obtain a second liquid phase effluent, and a third conduit configured to obtain a vapor phase effluent exiting the vessel; one or more second heat exchangers configured to heat at least a portion of the first liquid phase effluent in the first conduit to produce a heated first fluid stream; a recycle conduit in fluid communication with the one or more second heat exchangers configured to recycle at least a portion of the heated first fluid stream to the vessel; one or more third heat exchangers disposed within the convection section of the steam cracking furnace configured to heat the second liquid phase effluent to produce a heated second fluid stream; a separation drum configured to receive and to separate a vapor phase overhead and a liquid phase bottoms from the heated second fluid stream; one or more radiant tubes disposed within a radiant section of the steam cracking furnace configured to receive and steam crack at least a portion of the vapor phase overhead to produce a steam cracker effluent comprising olefins.

C2. The system of C1, wherein the third conduit configured to obtain the vapor phase effluent exiting the vessel is configured to introduce at least a portion of the vapor phase effluent to the first heat exchanger as a portion of the hydrocarbon feed, introduce at least a portion of the vapor phase effluent into a gas recovery unit and/or a primary fractionator configured to receive at least a portion of the steam cracker effluent, a vent gas system or flare, or a combination thereof.

C3. The system of C1 or C2, wherein the first conduit configured to obtain the first liquid phase effluent and the second conduit configured to obtain the second liquid phase effluent are in fluid communication with the vessel such that a composition of the first liquid phase effluent obtained via the first conduit is configured to be different than a composition of the second liquid phase effluent obtained via the second conduit.

C4. The system of C3, wherein the first liquid phase effluent obtained via the first conduit is configured to have a greater concentration of a char as compared to the second liquid phase effluent.

C5. The system of any one of C1 to C4, wherein: the system is configured to periodically stop introduction of the heated mixture and the heavy feed into the vessel, the system is configured to periodically stop recovery of the second liquid phase effluent from the vessel, and the system is configured to heat the heated mixture within the third heat exchanger to produce the heated second fluid stream such that the heated mixture alone is heated within the third heat exchanger, introduced into the separation drum, and a vapor phase derived from the heated mixture alone is steam cracked within the one or more radiant tubes to produce the steam cracker effluent.

C6. The system of C5, wherein, during the periodic stopping of the introduction of the heated mixture and the heavy feed into the vessel and recovery of the second liquid phase effluent, the plastic material in the heavy feed is configured to continue to undergo pyrolysis within the vessel.

C7. The system of any one of C1 to C5, further comprising a liquid phase bottoms recycle conduit configured to recycle at least a portion of the liquid phase bottoms from the separation drum to the vessel, the one or more first heat exchangers, or a combination thereof.

C8. The system of any one of C1 to C7, wherein at least one of the one or more second heat exchangers is disposed within the convection section of the steam cracking furnace.

C9. The system of any one of C1 to C8, wherein at least one of the one or more second heat exchangers is an external heat exchanger located outside of the steam cracking furnace.

C10. The system of C9, wherein the external heat exchanger is configured to transfer heat from a heated hydrocarbon, steam, or a combination thereof, or transfer heat from one or more electrical heating elements, or a combination thereof to the at least a portion of the liquid phase effluent in the first conduit to produce the heated fluid stream.

C11. The system of any one of C1 to C10, further comprising a separation vessel in fluid communication with the first conduit configured to receive at least a portion of the liquid phase effluent and to separate at least a portion of any char therefrom to produce a char-lean liquid phase effluent.

C12. The system of C11, wherein the one or more second heat exchangers are configured to receive and heat at least a portion of the char-lean liquid phase effluent to produce the heated first fluid stream.

C13. The system of C11 or C12, wherein the separation vessel is located between the vessel and a pump, and wherein the pump is configured to convey the char-lean liquid phase effluent into the one or more second heat exchangers.

C14. The system of C11 or C12, wherein the separation vessel is located between a pump and the second heat exchanger, and wherein the pump is configured to convey the liquid phase effluent into the separation vessel.

C15. The system of any one of C1 to C14, further comprising a guard bed configured to contact the vapor phase effluent to remove at least a portion of any contaminant-containing compound, mercury, ammonia, or a combination thereof therefrom to produce a contaminant-lean vapor phase stream.

C16. The system of C15 wherein the guard bed is located within the vessel.

C17. The system of C15, wherein the guard bed is located within a halide removal unit in fluid communication with the third conduit, the halide removal unit configured to receive the vapor phase effluent.

C18. The system of any one of C1 to C15, wherein the vessel comprises a first vessel and a second vessel, and wherein the heated mixture and the heavy feed are batch processed in the first vessel and the second vessel.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A process for converting hydrocarbons by pyrolysis, comprising:

heating a hydrocarbon feed within a convection section of a steam cracking furnace and combining the hydrocarbon feed with an aqueous fluid to produce a heated mixture comprising hydrocarbons and steam, wherein the heating is carried out before, during, and/or after the hydrocarbon feed is combined with the aqueous fluid, and wherein the heated mixture is a two-phase gas/liquid mixture;

introducing the heated mixture and a heavy feed comprising a plastic material into a vessel;

cracking a portion of the plastic material within the vessel under plastic pyrolysis conditions;

obtaining a liquid phase effluent and a vapor phase effluent exiting the vessel;

heating at least a portion of the liquid phase effluent to produce a heated fluid stream;

recycling at least a portion of the heated fluid stream to the vessel;

heating the vapor phase effluent within the convection section of the steam cracking furnace to produce a heated vapor phase effluent; and steam cracking the heated vapor phase effluent within a radiant section of the steam cracking furnace to produce a steam cracker effluent comprising olefins.

2. The process of claim 1, wherein the liquid phase effluent is heated in an internal heat exchanger disposed within the convection section of the steam cracking furnace.

3. The process of claim 1, wherein the liquid phase effluent is heated within an external heat exchanger outside of the steam cracking furnace.

4. The process of claim 3, wherein the liquid phase effluent is heated within the external heat exchanger by transferring heat from a heated hydrocarbon, a heated aqueous fluid, or a combination thereof, or by transferring heat from one or more electrical heating elements, or a combination thereof, and wherein, if present, the heated hydrocarbon comprises the stream cracker effluent, a cooled steam cracker effluent, a refinery hydrocarbon-containing stream, or a combination thereof.

5. The process of claim 1, further comprising removing a portion of the liquid phase effluent from the process.

6. The process of claim 1, wherein the heavy feed further comprises a carrier liquid mixed with the plastic material.

7. The process of claim 1, further comprising mixing a carrier liquid with at least a portion of the liquid phase effluent to produce a combined liquid phase mixture, wherein the combined liquid phase mixture is heated to produce the heated fluid stream.

8. The process of claim 1, wherein the liquid phase effluent comprises a char, and the process further comprises:

introducing at least a portion of the liquid phase effluent into a separation vessel; and separating at least a portion of the char from the at least a portion of the liquid phase effluent to produce a char-lean liquid phase effluent, wherein at least a portion of the char-lean liquid phase effluent is heated to produce the heated fluid stream.

9. The process of claim 8, wherein the heavy feed further comprises a carrier liquid mixed with the plastic material.

10. The process of claim 8, further comprising mixing a carrier liquid with at least a portion of the char-lean liquid phase effluent to produce a combined liquid phase mixture, wherein the combined liquid phase mixture is heated to produce the heated fluid stream.

11. The process of claim 6, wherein the carrier liquid comprises a heat-soaked and/or hydrotreated hydrocarbon stream having an initial boiling point of at least 300° C.

12. The process of claim 1, wherein the plastic material comprises a contaminant-containing polymer and/or the heavy feed further comprises a compound comprising contaminant, and wherein the vapor phase effluent further comprises one or more contaminant-containing compounds, the process further comprising:

contacting the vapor phase effluent with a guard bed to remove at least a portion of the one or more contaminant-containing compounds to produce a contaminant-lean vapor phase stream, wherein the contaminant-lean vapor phase stream is combined with the heated mixture to produce the combined mixture.

13. The process of claim 12, wherein the plastic material comprises the contaminant-containing polymer, and wherein the contaminant-containing polymer comprises polyvinyl chloride, polyvinylidene chloride, chlorinated polyvinyl chloride, or a mixture thereof.

14. The process of claim 1, wherein the plastic pyrolysis conditions in the vessel comprises a temperature in a range from 300° C. to 550° C.

15. The process of claim 1, wherein the plastic material comprises a nitrogen-containing polymer, a chlorine-containing polymer, an oxygen-containing polymer, a polyethylene polymer, a polypropylene polymer, a polystyrene polymer, a polyamide polymer, polyethylene terephthalate, ethylene vinyl acetate, a butadiene polymer, an isoprene polymer, an isobutylene polymer, or a mixture thereof.

16. The process of claim 1, wherein the hydrocarbon feed comprises crude oil or a fraction thereof.

* * * * *